US005356767A

United States Patent [19]

Toyoda et al.

[11] Patent Number: 5,356,767

[45] Date of Patent: Oct. 18, 1994

[54] SILVER HALIDE PHOTOGRAPHIC LIGHT-SENSITIVE MATERIAL CONTAINING AN ACYLACETAMIDE TYPE YELLOW DYE FORMING COUPLER HAVING AN ACYL GROUP AND A COMPOUND CAPABLE OF RELEASING A DEVELOPMENT INHIBITOR

[75] Inventors: Masayoshi Toyoda; Yasuhiro Yoshioka, both of Minami-Ashigara, Japan

[73] Assignee: Fuji Photo Film Co., Ltd., Kanagawa, Japan

[21] Appl. No.: 850,950

[22] Filed: Mar. 13, 1992

[30] Foreign Application Priority Data

Mar. 14, 1991 [JP] Japan ..... 3-74829

[51] Int. Cl.[5] ..... G03C 7/36; G03C 7/305

[52] U.S. Cl. ..... 430/544; 430/556; 430/557

[58] Field of Search ..... 430/556, 557, 544, 957

[56] References Cited

U.S. PATENT DOCUMENTS 4,268,591 5/1981 Tschopp ..... 430/17
4,937,179 6/1990 Hirano et al. ..... 430/544
4,985,336 1/1991 Ichijima et al. ..... 430/223
5,118,599 6/1992 Lau et al. ..... 430/557

FOREIGN PATENT DOCUMENTS 447969 9/1991 European Pat. Off. .

*Primary Examiner*—Lee C. Wright
*Attorney, Agent, or Firm*—Birch, Stewart, Kolasch & Birch

[57] ABSTRACT

A silver halide photographic light-sensitive material includes a support, and at least one light-sensitive silver halide emulsion layer formed on the support, wherein at least one of the light-sensitive silver halide emulsion layers contains at least one type of an acylacetamide type yellow dye forming coupler having an acyl group represented by formula (I) below, and at least one type of a compound represented by formula (W) below:

Formula (I)

$$A-\{(L_1)_l-(B)_m\}_p-(L_2)_n-DI$$

Formula (W)

wherein DI represents a development inhibitor.

19 Claims, No Drawings

SILVER HALIDE PHOTOGRAPHIC LIGHT-SENSITIVE MATERIAL CONTAINING AN ACYLACETAMIDE TYPE YELLOW DYE FORMING COUPLER HAVING AN ACYL GROUP AND A COMPOUND CAPABLE OF RELEASING A DEVELOPMENT INHIBITOR

BACKGROUND OF THE INVENTION

1. Field of the Invention

The present invention relates to a silver halide color photographic light-sensitive material and, more particularly, to a silver halide color photographic light-sensitive material having a high saturation, an improved sharpness, and a remarkably improved dark storage stability of a dye image after development.

2. Description of the Related Art

As a silver halide color photographic light-sensitive material, it is a common practice to use a material containing three types of color couplers which couple with an oxidized form of an aromatic primary amine-based color developing agent to form yellow, magenta, and cyan colors.

As the yellow coupler of the above couplers, an acylacetamide coupler represented by a benzoylacetanilide coupler or a pivaloylacetanilide coupler is generally used. The benzoylacetamide type coupler has a high coupling activity with an aromatic primary amine developing agent and can produce a yellow dye having a large molecular absorptivity coefficient. However, this coupler has a problem of low dye stability upon dark storage. The pivaloylacetamide type coupler is excellent in a dye stability but is low in a coupling reactivity upon development and has only a small molecular absorptivity coefficient. Therefore, a large amount of the color forming coupler must be used in order to obtain a sufficient dye density, and this results in disadvantages in both an image quality and a cost.

Various studies, on the other hand, have been made on an acyl group of the acylacetamide type yellow coupler. For example, U.S. Pat. Re. No. 27,848 discloses couplers having a 7,7-dimethylnorbornane-1-carbonyl group and a 1-methylcyclohexane-1-carbonyl group as variations of the pivaloyl group. However, these couplers are low in a coupling activity and can produce only dyes having small molecular absorptivity coefficients. JP-A-47-26133 ("JP-A" means Published Unexamined Japanese Patent Application) discloses couplers having a cyclopropane-1-carbonyl group and a cyclohexane-1-carbonyl group. These couplers, however, are still unsatisfactory because the stabilities of produced dyes are low. For these reasons, a demand has arisen for development of a yellow coupler having both good color forming properties (i.e., a high coupling activity of the coupler and a large molecular absorptivity coefficient of a produced dye) and a good dye stability.

On the other hand, miniaturization in format and size is required for recent color photographic light-sensitive materials, and this requires a further improvement in an image quality. That is, it is now unsatisfactory only to reduce the amount of couplers or high boiling point organic solvents to form thin layers by using couplers having good color forming properties, thereby improving a sharpness. It is also unsatisfactory only to improve a color saturation by using couplers having good color forming properties without increasing the coupler amount used (without deteriorating sharpness).

As a means for improving a sharpness or color saturation, it is known to use development inhibitor releasing compounds described in, e.g., JP-A-2-154256, JP-A-1-105947, JP-A-1-140152, JP-A-63-23152, JP-A-61-240240, JP-A-61-233741, and JP-A-61-231553. However, the use of these compounds alone is still unsatisfactory.

SUMMARY OF THE INVENTION

It is an object of the present invention to provide a silver halide color photographic light-sensitive material having a high saturation, a good sharpness, and a remarkably improved dark storage stability of a dye after development.

The above object of the present invention is achieved by a silver halide photographic light-sensitive material comprising a support, and at least one light-sensitive silver halide emulsion layer formed on the support, wherein at least one of the light-sensitive silver halide layers contains at least one type of an acylacetamide type yellow dye forming coupler having an acyl group represented by formula (I) below, and at least one type of a compound represented by formula (W) below:

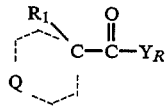

wherein $R_1$ represents a monovalent group and Q represents a nonmetallic atom group required to form, together with C, a 3- to 5-membered hydrocarbon ring or a 3- to 5-membered heterocyclic ring having at least one hetero atom selected from N, O, S, and P in the ring. Note that $R_1$ is not a hydrogen atom and does not combine with Q to form a ring and $Y_R$ represents a residue remaining after removing the acyl group

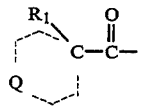

from the acylacetamido yellow dye forming coupler represented by formula (I).

$$A-\{(L_1)_l-(B)_m\}_p-(L_2)_n-DI \qquad \text{Formula (W)}$$

wherein A represents a group whose bond with a moiety except for A cleaves when reacting with an oxidized form of an aromatic primary amine developing agent, $L_1$ represents a group whose bond (a bond with $(B)_m$) on the right side of $L_1$ in formula (W) cleaves when a bond on the left side of $L_1$ cleaves, B represents a group whose bond with the right side of B in formula (W) cleaves when reacting with the oxidized form of a developing agent, $L_2$ represents a group whose bond on the right side of $L_2$ in formula (W) cleaves when a bond on the left side of $L_2$ cleaves, DI represents a development inhibitor, each of l, m, and n independently represents 0 or 1, and p represents an integer of 0 to 3. If p represents a plural number, p $(L_1)_l$—$(B)_m$'s may be the same or different.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

The present invention will be described in detail below.

By properly selecting l, m, n, and p, it is possible for a compound represented by formula (W) to achieve various properties in a process of releasing DI. That is the present invention includes a group of compounds (W) whose molecular design can be made in accordance with various applications.

In a preferable embodiment of the present invention, the compound (W) of $l+m+n+p \geqq 3$, and most preferably $l+m+n+p=3$ is used. In this case, a compound represented by formula (W) has a strong interlayer effect and a strong edge effect as well as an excellent color reproducibility and an excellent sharpness. More preferably, a compound (W) in which $l+m+n+p$ is 0 to 2 is also used together with the above compound (W). That is, the combination of these two types of compounds is preferable to control a gradation and to obtain a uniform interlayer effect.

The reaction in which a compound represented by formula (W) releases DI is represented by the following reaction formula for $p=1$:

$$A-(L_1)_l-(B)_m-(L_2)_n-DI \xrightarrow{T^+}$$

$$(L_1)_l-(B)_m-(L_2)_n-DI \longrightarrow$$

$$(B)_m-(L_2)_n-DI \xrightarrow{T^+} (L_2)_n-DI \longrightarrow DI$$

wherein A, $L_1$, B, $L_2$, DI, l, m, and n: represent the same meanings as described above in formula (W), and T+ represents an oxidized form of a developing agent.

A compound represented by formula (W) will be described in detail below.

In formula (W), A specifically represents a coupler moiety or an oxidation-reduction group.

Examples of the coupler moiety represented by A are a yellow coupler moiety (e.g., an open chain ketomethylene type coupler moiety such as acylacetanilide or malondianilide), a magenta coupler moiety (e.g., a coupler moiety of a 5-pyrazolone type, a pyrazolotriazole type, or a pyrazoloimidazole type), a cyan coupler moiety (e.g., a coupler moiety of a phenol type, a 10 naphthol type, or an imidazole type described in EP 249,453), and a colorless compound forming coupler moiety (e.g., a coupler moiety of an indanone type or an acetophenone type). It is also possible to use heterocyclic coupler moleties described in U.S. Pat. Nos. 4,315,070, 4,183,752, 4,174,969, 3,961,959, and 4,171,223.

When A represents an oxidation-reduction group, this oxidation-reduction group is a group which can be cross-oxidized by an oxidized form of a developing agent. Examples of the group are hydroquinones, catecols, pyrogallols, 1,4-naphthohydroquinones, 1,2-naphthohydroquinones, sulfonamidephenols, hydrazides, and sulfonamidenaphthols. Practical examples of these groups are described in, e.g., JP-A-61-230135, JP-A-62-251746, JP-A-61-278852, U.S. Pat. Nos. 3,364,022, 3,379,529, 3,639,417, and 4,684,604, and J. Org. Chem., 29,588 (1964).

Examples of a linking group represented by $L_1$ and $L_2$ in formula (W) are a group described in U.S. Pat. Nos. 4,146,396, 4,652,516, or 4,698,297, which uses a cleavage reaction of hemiacetal; a timing group described in U.S. Pat. No. 4,248,962, which causes a cleavage reaction by using an intramolecular nucleophilic reaction; a timing group described in U.S. Pat. Nos. 4,409,323 or 4,421,845, which causes a cleavage reaction by using an electron transfer reaction; a group described in U.S. Pat. No. 4,546,073, which causes a cleavage reaction by using a hydrolytic reaction of iminoketal; and a group described in west German Patent 2,626,317, which causes a cleavage reaction by using a 7hydrolytic reaction of ester. Each of $L_1$ and $L_2$ are bonded with A or A-$(L_1)_l$—$(B)_m$ via a hetero atom, preferably an oxygen atom, a sulfur atom, or a nitrogen atom contained in it.

A group represented by B in formula (W) is a group which cleaves from A-$(L_1)_l$ to form an oxidation-reduction group or a coupler moiety. Note that an oxidation-reduction group and a coupler moiety have the same meaning as described above for A. A group represented by B has a group which splits off when reacting with an oxidized form of a developing agent (i.e., a group which is bonded to the right side of B in formula (W)). Examples of a group represented by B are a group represented by B in JP-A-63-6550; a group represented by COUP(B) in U.S. Pat. No. 4,438,193; and a group represented by RED in U.S. Pat. No. 4,618,571. B preferably is bonded with A—$(L_1)_l$ via a hetero atom, preferably an oxygen atom, a sulfur atom, or a nitrogen atom contained in it.

Examples of a group represented by DI in formula (W) are a tetrazolylthio group, a thiadiazolylthio group, an oxadiazolylthio group, a triazolylthio group, a benzimidazolylthio group, a benzthiazolylthio group, a tetrazolylseleno group, a benzoxazolylthio group, a benzotriazolyl group, a triazolyl group, and a benzoindazolyl group. These groups are described in, e.g., U.S. Pat. Nos. 3,227,554, 3,384,657, 3,615,506, 3,517,291, 3,733,201, 3,933,500, 3,958,993, 3,961,959, 4,149,886, 4,259,437, 4,095,984, and 4,477,563, and British Patent 1,450,479.

Preferable ranges of a compound represented by formula (W) will be described below.

p is preferably 0 to 2.

A linking group represented by $L_1$ or $L_2$ is preferably a methyleneoxy group, a 4-methylene-3-pyrazolyloxy group, a 2 (or 4)-methylenephenoxy group, or a 2-carbonylaminomethylphenoxy group. Each of these groups are bonded with a group on the left side of $L_1$ or $L_2$ in formula (W). These divalent groups may also have substituents at a substitutable position (e.g., at a methylene group or a benzene ring). Representative examples of the substituent are an alkyl group (e.g., methyl, ethyl, isopropyl, and dodecyl), an acyl group (e.g., benzoyl or acetyl), an alkoxy group (e.g., methoxy or ethoxy), an alkoxycarbonyl group (e.g., methoxycarbonyl and butoxycarbonyl), a carbamoyl group (e.g., ethylcarbamoyl), a nitro group, a carboxyl group, a sulfonyl group (e.g., methanesulfonyl), an aryl group (e.g., 4-nitrophenyl and 4-carboxyphenyl), a halogen atom (e.g., a chlorine atom and a fluorine atom), and a sulfamoyl group (e.g., octadecylsulfamoyl).

A compound represented by formula (W) is of preferably a nondiffusing type, and most preferably a nondiffusing type in which a nondiffusing group is contained in A, $L_1$, or $L_2$.

A particularly preferable example of a compound represented by formula (W) is a compound in which A represents a coupler moiety.

A particularly preferable example of a compound represented by formula (W) is a compound in which l=1, m=0, p=1, and n=1; Z=1, m=1, p=1, and n=0; l=0, m=1, p=1, and n=1; or Z=0, m=1, p=2, and n=0. These compounds are excellent particularly in a color reproducibility obtained by an interlayer effect and a sharpness obtained by an edge effect.

Examples of a compound represented by formula (W) and methods of synthesizing the compound are described in the well-known patents or references cited above for explaining A, $L_1$, B, $L_2$, and DI in formula (W), and JP-A-63-37346 and JP-A-61-156127.

(1)

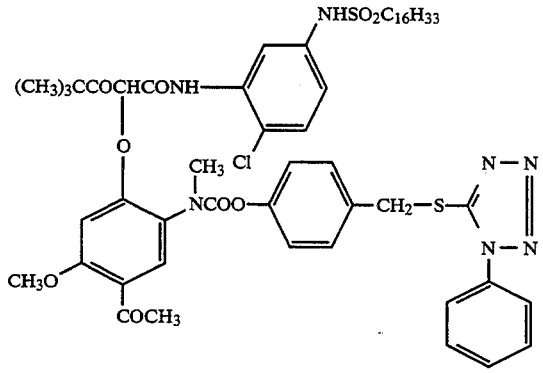

(2)

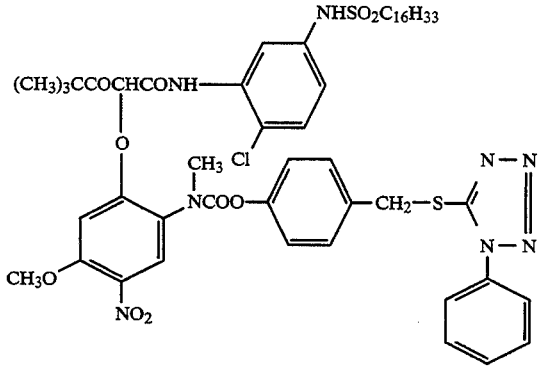

(3)

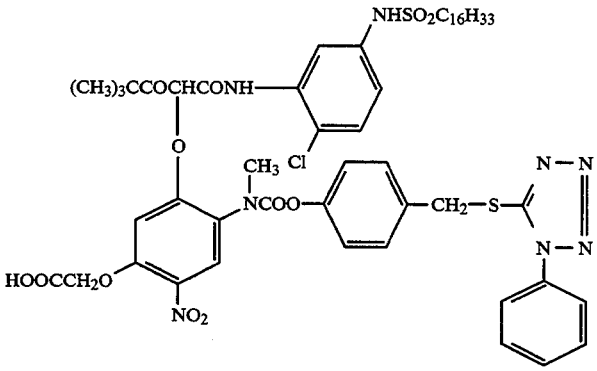

(4)

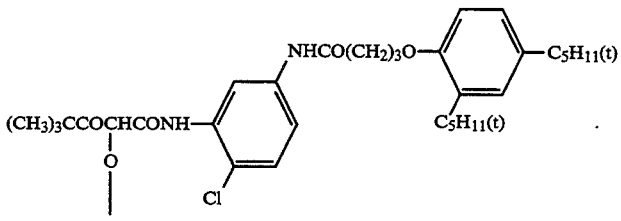

-continued
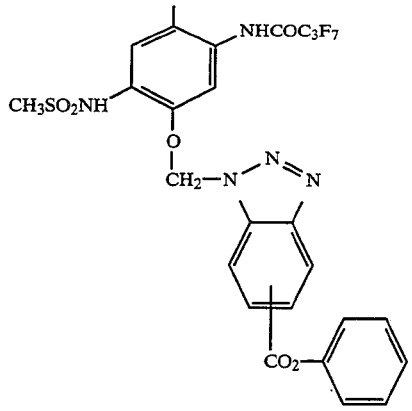
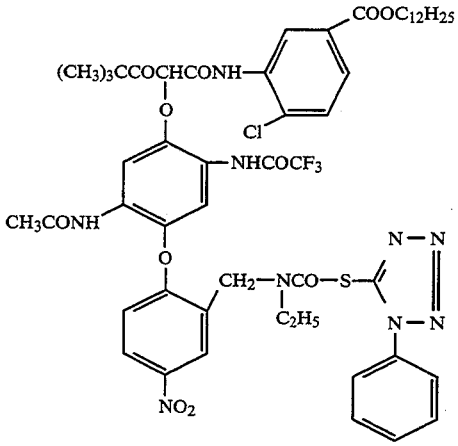
(5)
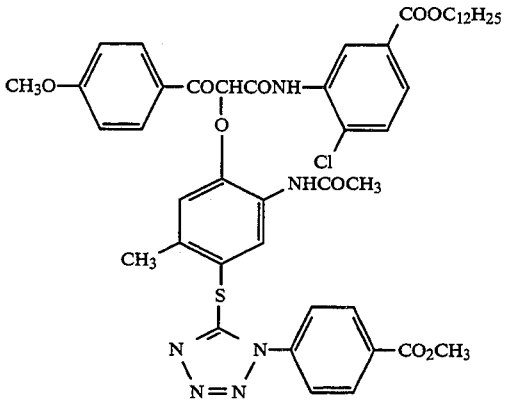
(6)

-continued
(7)
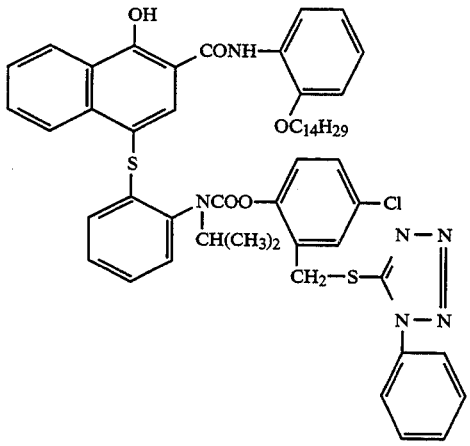
(8)
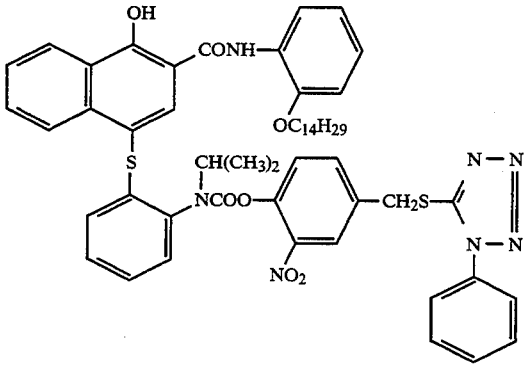
(9)
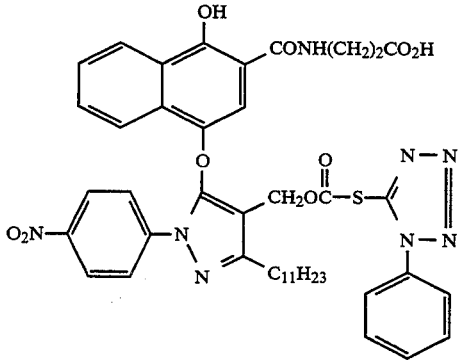
(10)
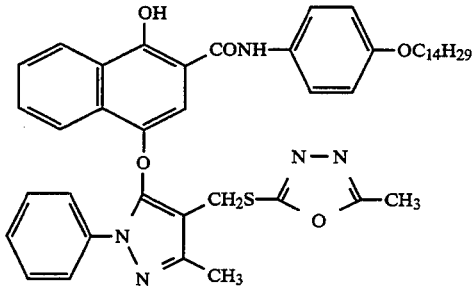

-continued
(11)
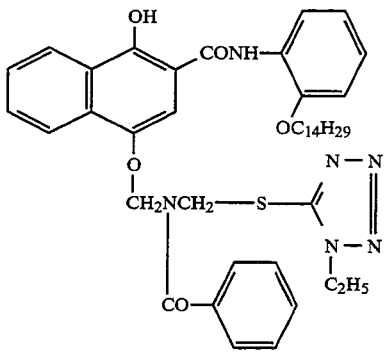
(12)
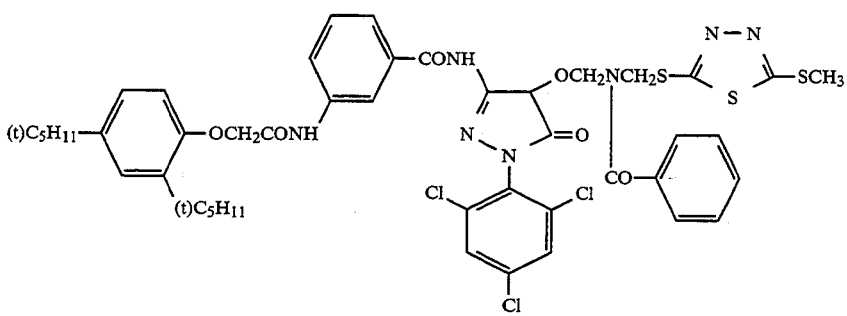
(13)
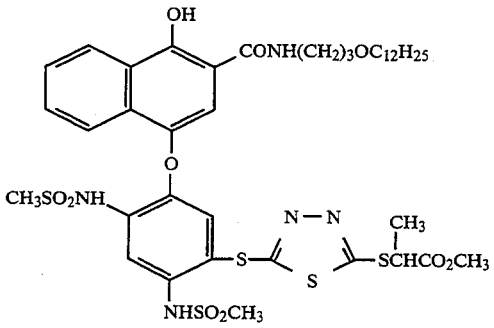
(14)
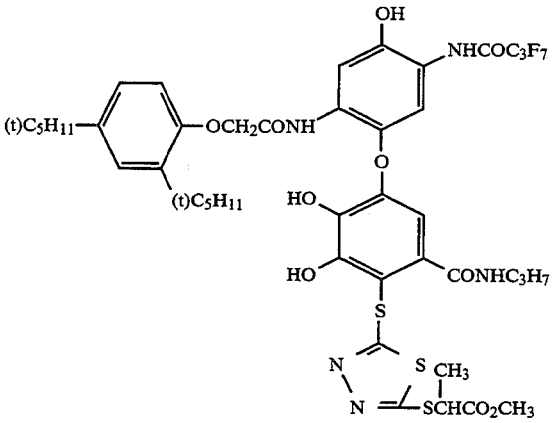

-continued
(15)
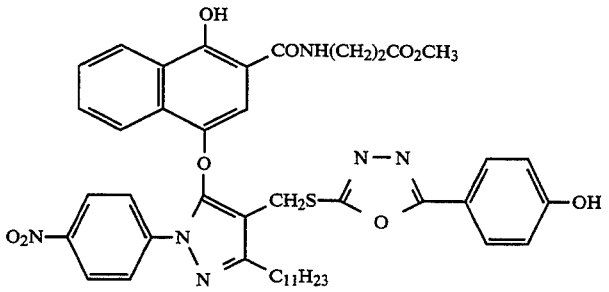
(16)
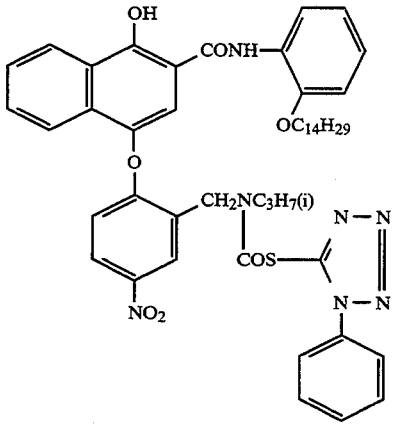
(17)
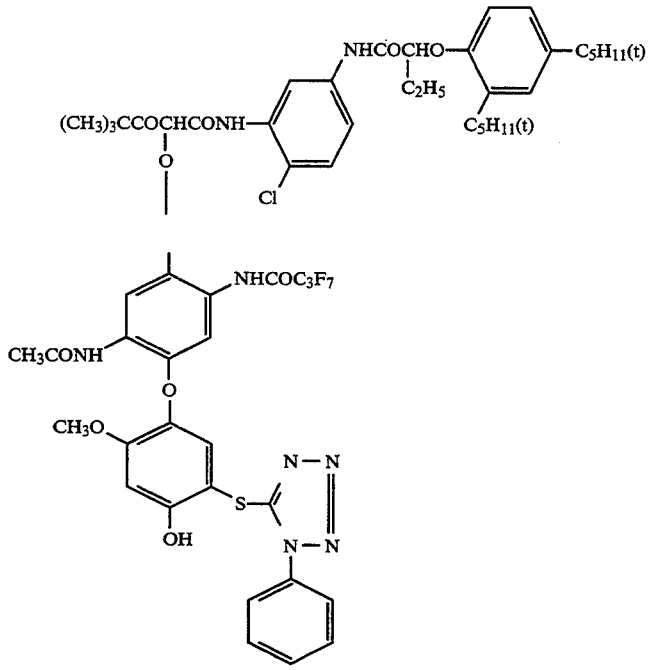
(18)
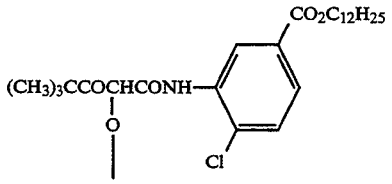

-continued
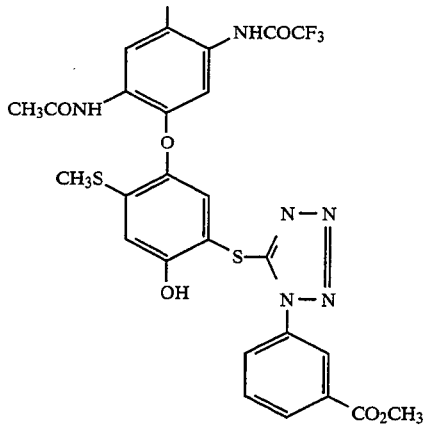
(19)
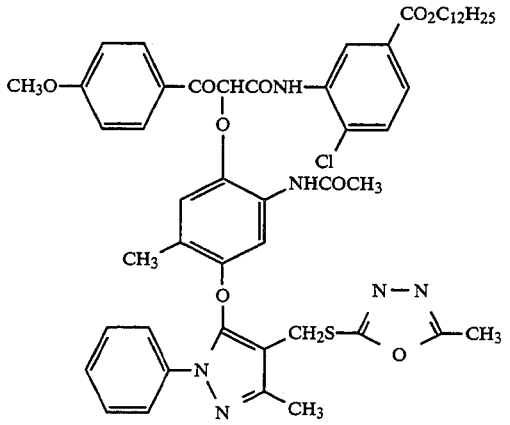
(20)
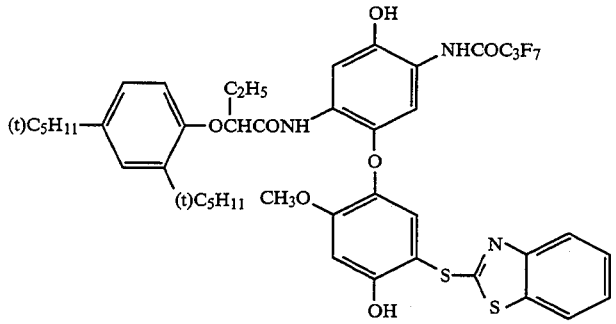
(21)
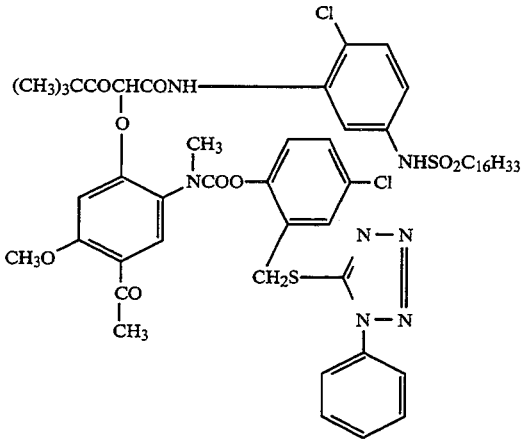

-continued
(22)
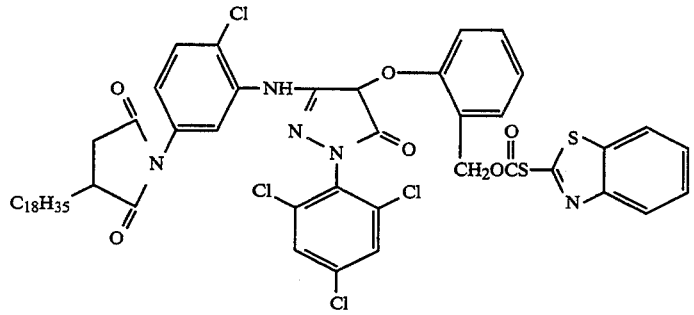
(23)
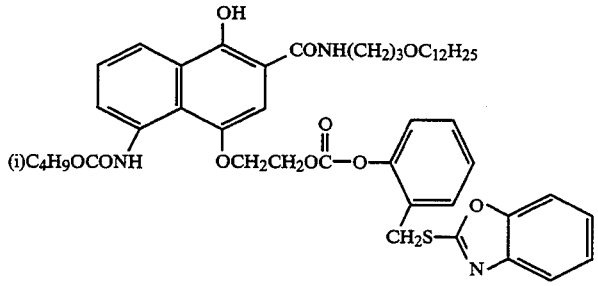
(24)
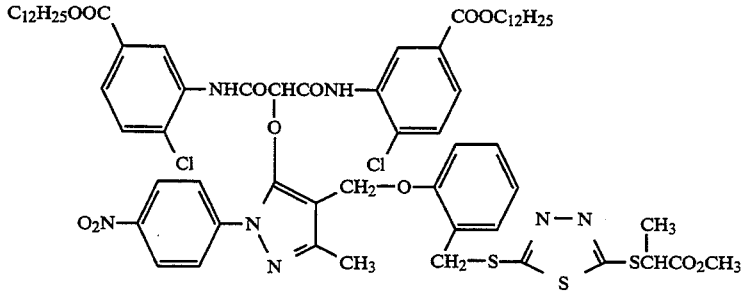
(25)
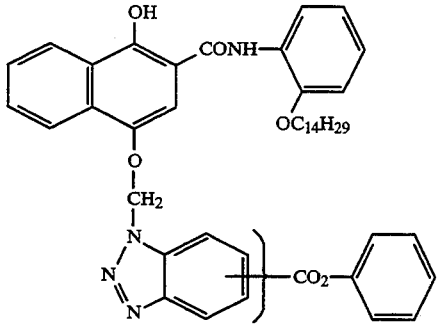
(26)
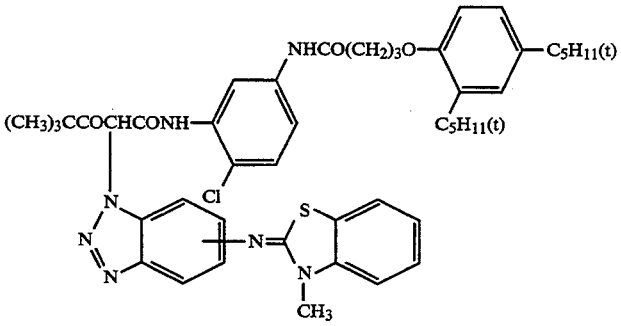

-continued
(27)
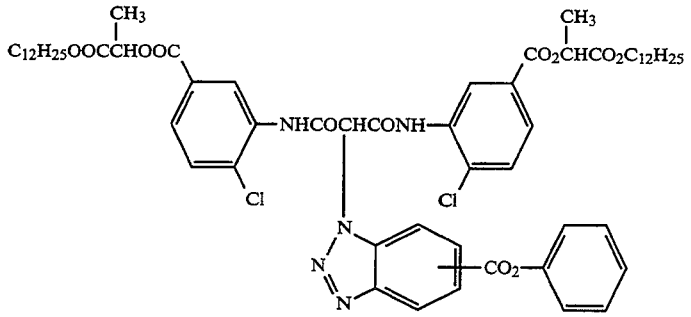
(28)
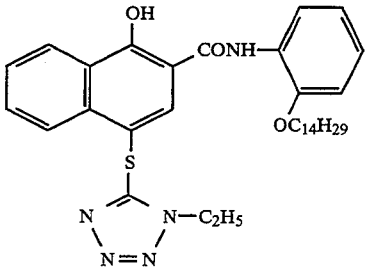
(29)
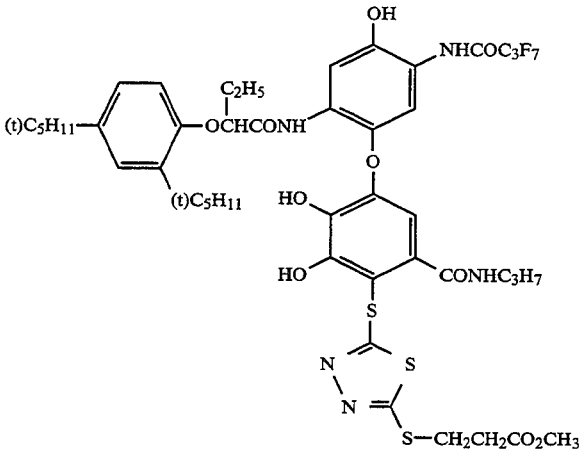
(30)
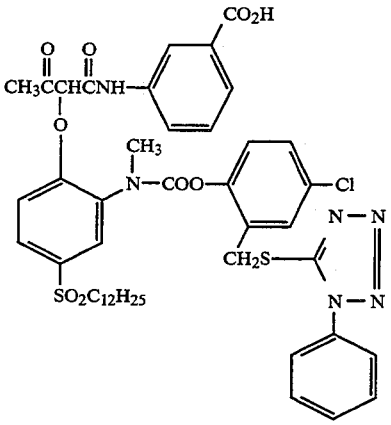

-continued
(31)
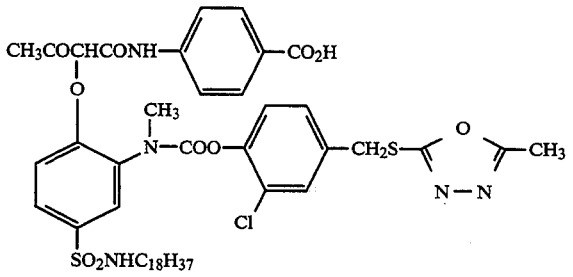
(32)
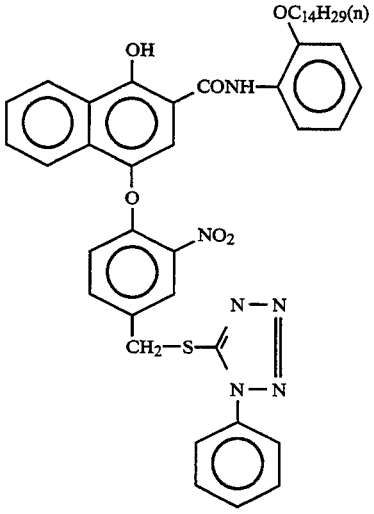
(33)
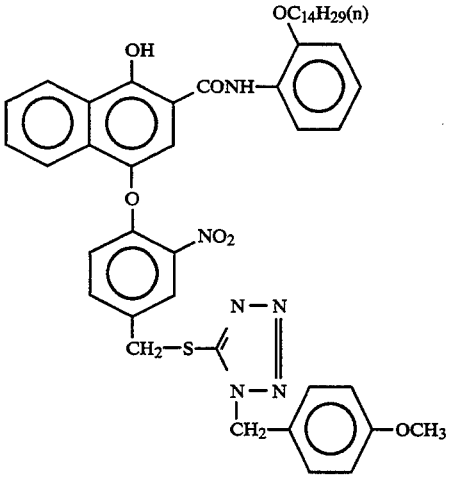

-continued
(34)
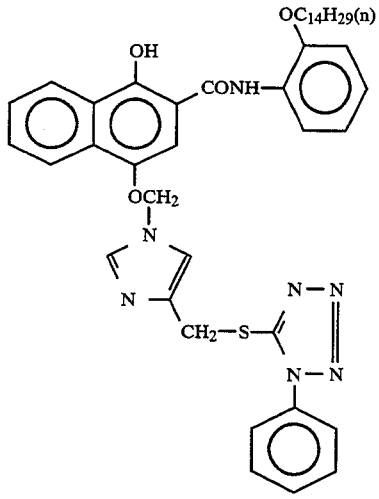
(35)
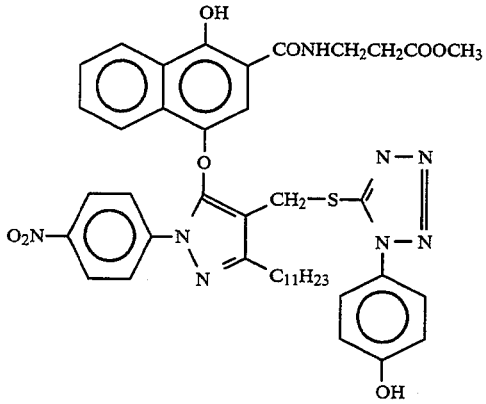
(36)
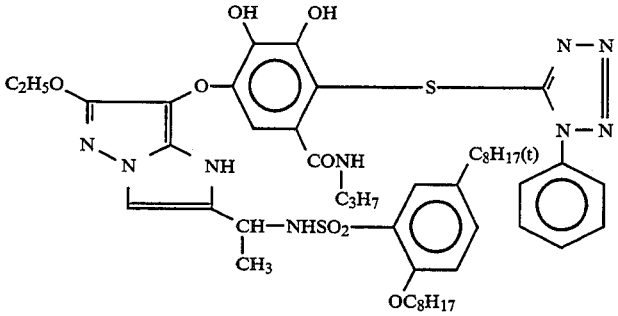
(37)
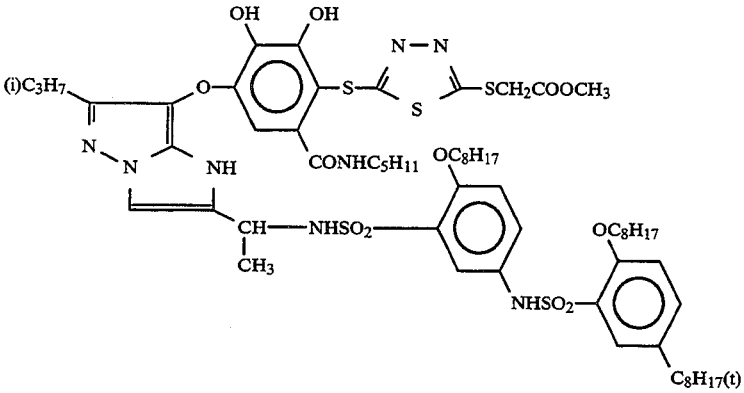

-continued (38)

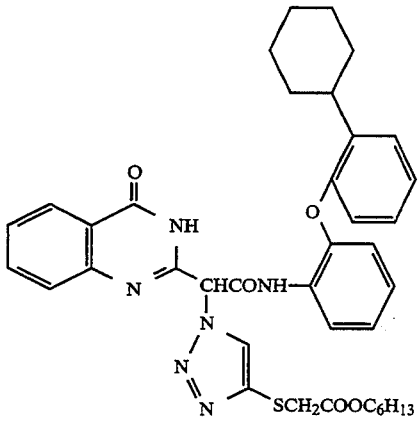

(39)

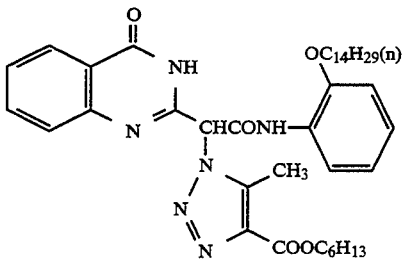

A compound represented by formula (W) of the present invention is preferably added to light-sensitive silver halide emulsion layers in a light-sensitive material. The addition amount is $2\times10^{-4}$ to $1\times10^{-1}$ mol, preferably $5\times10^{-4}$ to $5\times10^{-2}$ mol, and more preferably $1\times10^{-3}$ to $1\times10^{-2}$ mol per mol of a silver halide. Similar to couplers, a compound represented by formula (W) can be introduced, in the form of an emulsified dispersion, into the light-sensitive material by using various well-known dispersion methods, particularly an oil-in-water dispersion method.

A compound represented by formula (I) will now be described below. As described previously, $Y_R$ in formula (I) represents the remaining portion of formula (I) that does not correspond to the acyl group of formula (I). Preferably, $Y_R$ represents the following residue as shown in formula (Y) described later.

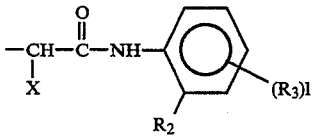

wherein the substituents are as defined in formula (Y).

An acylacetamide type yellow coupler of the present invention is preferably represented by formula (Y) below:

Formula (Y)

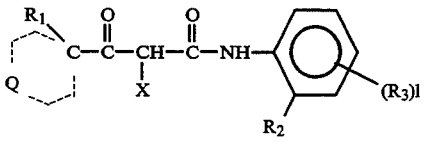

wherein $R_1$ represents a monovalent substituent except for hydrogen, Q represents a nonmetallic atom group required to form, together with C, a 3- to 5-membered hydrocarbon ring or a 3- to 5-membered heterocyclic ring containing at least one hereto atom selected from N, S, O, and P in the ring, $R_2$ represents a hydrogen atom, a halogen atom (F, Cl, Br, or I; this will be the same in explanation of formula (Y) hereinafter), an alkoxy group, an aryloxy group, an alkyl group, or an amino group, $R_3$ represents a group substitutable on a benzene ring, X represents a group (to be referred to as a split-off group hereinafter) which can split off upon a coupling reaction with a hydrogen atom or an oxidized form of an aromatic primary amine developing agent, and l represents an integer from 0 to 4. If l represents a plural number, a plurality of $R_3$'s may be the same or different.

Examples of $R_3$ are a halogen atom, an alkyl group, an aryl group, an alkoxy group, an aryloxy group, an alkoxycarbonyl group, an aryloxycarbonyl group, a carbonamide group, a sulfonamide group, a carbamoyl group, a sulfamoyl group, an alkylsulfonyl group, an ureido group, a sulfamoylamino group, an alkoxycarbonylamino group, an alkoxysulfonyl group, an acyloxy group, a nitro group, a heterocyclic group, a cyano group, an acyl group, an acyloxy group, an alkylsulfonyloxy group, and an arylsulfonyloxy group. Examples of the split-off group are a heterocyclicigroup, which combines with a coupling active position by a nitrogen atom, an aryloxy group, an arylthio group, an acyloxy group, an alkylsulfonyloxy group, an arylsulfonyloxy group, a heterocyclic oxy group, and a halogen atom.

If the substituent in formula (Y) is an alkyl group or contains an alkyl group, this alkyl group means, unless defined otherwise, a straight-chain, branched, or cyclic alkyl group (e.g., methyl, isopropyl, t-butyl, cyclopentyl, t-pentyl, cyclohexyl, 2-ethylhexyl, 1,1,3,3-tetramethylbutyl, dodecyl, hexadecyl, allyl, 3-cyclohexenyl, oleyl, benzyl, trifiuoromethyl, hydroxymethylmethoxyethyl, ethoxycarbonylmethyl, and phenoxyethyl)

which may be substituted and may contain an unsaturated bond.

If the substituent in formula (Y) is an aryl group or contains an aryl group, this aryl group means a monocyclic or condensed-ring aryl group (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidephenyl, and 3,4-dichlorophenyl) which may be substituted, unless defined otherwise.

If the substituent in formula (Y) is a heterocyclic group or contains a heterocyclic group, this heterocyclic group means a 3- to 8-membered monocyclic or condensed-ring heterocyclic group (e.g., 2-furyl, 2-pyridyl, 4-pyridyl, 1-pyrazolyl, 1-imidazolyl, 1-benzotriazolyl, 2-benzotriazolyl, succinimide, phthalimide, and 1-benzyl-2,4-imidazolidinedione-3-yl) which contains at least one hetero atom selected from O, N, S, P, Se, and Te in its ring and may be substituted, unless defined otherwise.

Substituents which can be preferably used in formula (Y) will be described below.

In formula (Y), $R_1$ is preferably a halogen atom, a cyano group, or a monovalent group (e.g., an alkyl group or an alkoxy group) having a total number of carbon atoms (to be referred to as a C number hereinafter) of 1 to 30 or a monovalent group (e.g., an aryl group or an aryloxy group) having a C number of 6 to 30, each monovalent group of which may be substituted. Examples of substituents of these monovalent groups are a halogen atom, an alkyl group, an alkoxy group, a nitro group, an amino group, a carbonamide group, a sulfonamide group, and an acyl group.

In formula (Y), Q preferably represents a nonmetallic atom group required to form, together with C, a 3- to 5-membered hydrocarbon group which has a C number of 3 to 30 and may be substituted or a 3- to 5-membered heterocyclic group which contains at least one hetero atom selected from N, S, O, and P, has a C number of 2 to 30, and may be substituted. The ring that Q forms together with C may contain an unsaturated bond in it. Examples of the ring formed by Q with C are a cyclopropane ring, cyclobutane ring, a cyclopentane ring, a cyclopropane ring, a cyclobutene ring, a cyclopentene ring, an oxetane ring, an oxolane ring, a 1,3-dioxolane ring, a thiethane ring, a thiolane ring, and a pyrrolidine ring. Examples of the substituent are a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (Y), $R_2$ preferably represents a halogen atom, or an alkoxy group having a C number of 1 to 30, an aryloxy group having a C number of 6 to 30, an alkyl group having a C number of 1 to 30, or an amino group having a C number of 0 to 30, each of which may be substituted. Examples of the substituent are a halogen atom, an alkyl group, an alkoxy group, and an aryloxy group.

In formula (Y), $R_3$ preferably represents a halogen atom, or an alkyl group having a C number of 1 to 30, an aryl group having a C number of 6 to 30, an alkoxy group having a C number of 1 to 30, an alkoxycarbonyl group having a C number of 2 to 30, an aryloxycarbonyl group having a C number of 7 to 30, a carbonamide group having a C number of 1 to 30, a sulfonamide group having a C number of 1 to 30, a carbamoyl group having a C number of 1 to 30, a sulfamoyl group having a C number of 0 to 30, an alkylsulfonyl group having a C number of 1 to 30, an arylsulfonyl group having a C number of 6 to 30, an ureido group having a C number of 1 to 30, a sulfamoylamino group having a C number of 0 to 30, an alkoxycarbonylamino group having a C number of 2 to 30, a heterocyclic group having a C number of 1 to 30, an acyl group having a C number of 1 to 30, an alkylsulfonyloxy group having a C number of 1 to 30, or an arylsulfonyloxy group having a C number of 6 to 30, each of which may be substituted. Examples of the substituent are a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamide group, a sulfonamide group, a carbamoyl group, a sulfamoyl group, an alkoxycarbonylamino group, a sulfamoylamino group, an ureido group, a cyano group, a nitro group, an acyloxy group, an alkoxycarbonyl group, an aryloxycarbonyl group, an alkylsulfonyloxy group, and an arylsulfonyloxy group.

In formula (Y), l preferably represents an integer of 1 or 2, and the substitution position of $R^3$ is preferably a meta or para position with respect to:

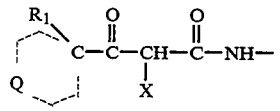

In formula (Y), X preferably represents a heterocyclic group or an aryloxy group which combines with a coupling active position via its nitrogen atom.

When X represents a heterocyclic group, X is preferably a 5- to 7-membered monocyclic or condensed-ring heterocyclic group. Examples of this heterocyclic group are succinimide, maleinimide, phthalimide, diglycolimide, pyrrole, pyrazole, imidazole, 1,2,4-triazole, tetrazole, indole, indazole, benzimidazole, benzotriazole, imidazolidine-2,4-dione, oxazolidine-2,4dione, thiazolidine-2,4-dione, imidazolidine-2-one, oxazolidine-2-one, thiazolidine-2-one, benzimidazolidine-2-one, benzoxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4thiazolidine, and 2-imino-1,3,4-thiazolidine-4-one. These heterocyclic rings may be substituted. Examples of the substituent are a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamide group, a sulfonamide group, a carbamoyl group, a sulfamoyl group, an ureido group, an alkoxycarbonylamino group, and a sulfamoylamino group. When X represents an aryloxy group, X is preferably an aryloxy group having a C number of 6 to 30 and may be substituted with a group selected from the substituents enumerated above as substituents when X represents a heterocyclic ring. Preferable examples of the substituent of the aryloxy group are a halogen atom, a cyano group, a nitro group, a carboxyl group, a trifluoromethyl group, an alkoxycarbonyl group, a carbonamide group, a sulfonamide group, a carbamoyl group, a sulfamoyl group, an alkylsulfonyl group, an arylsulfonyl group, and a cyano group.

Substituents which can be particularly preferably used in formula (Y) will be described below.

$R_1$ is particularly preferably a halogen atom or an alkyl group, more preferably methyl and most preferably ethyl. Q is particularly preferably a nonmetallic atom group for forming a 3- to 5-membered hydrocarbon ring together with C, for example, $-(C(R)_2)_2-$, $-(C(R)_2)_3-$, or $-(C(R)_2)_4-$ wherein R represents a hydrogen atom, a halogen atom, or an alkyl group. Note that a plurality of R's and $C(R)_2$'s may be the same or different.

Q is most preferably $-(C(R)_2)_2-$ which forms a 3-membered ring together with C.

$R_2$ is particularly preferably a chlorine atom, a fluorine atom, an alkyl group (e.g., methyl, trifluoromethyl, ethyl, isopropyl, and t-butyl) having a C number of 1 to 6, an alkoxy group (e.g., methoxy, ethoxy, methoxyethoxy, and butoxy) having a C number of 1 to 8, or an aryloxy group (e.g., a phenoxy group, p-tolyloxy, and p-methoxyphenoxy) having a C number of 6 to 24, and most preferably a chlorine atom, a methoxy group, or a trifluoromethyl group.

$R_3$ is particularly preferably a halogen atom, an alkoxy group, an alkoxycarbonyl group, an aryloxycarbonyl group, a carbonamide group, a sulfonamide group, a carbamoyl group, or a sulfamoyl group, and most preferably an alkoxy group, an alkoxycarbonyl group, a carbonamide group, or a sulfonamide group.

X is particularly preferably a group represented by formula (Y-1), (Y-2), or (Y-3) below:

Formula (Y-1)

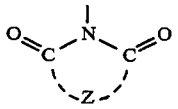

wherein Z represents $-O-CR_4(R_5)-$, $-S-CR_4(R_5)-$, $-NR_6-CR_4(R_5)-$, $NR_6-NR_7-$, $-NR_6-C(O)-$, $-CR_4(R_5)-CR_8(R_9)-$, or $-CR_{10}=CR_{11}-$.

Each of $R_4$, $R_5$, $R_8$, and $R_9$ represents a hydrogen atom, an alkyl group, an aryl group, an alkoxy group, an aryloxy group, an alkylthio group, an arylthio group, an alkylsulfonyl group, an arylsulfonyl group, or an amino group. Each of $R_6$ and $R_7$ represents a hydrogen atom, an alkyl group, an aryl group, an alkylsulfonyl group, an arylsulfonyl group, or an alkoxycarbonyl group. Each of $R_{10}$ and $R_{11}$ represents a hydrogen atom, an alkyl group, or an aryl group. $R_{10}$ and $R^{11}$ may combine together to form a benzene ring. $R_4$ and $R_5$, $R_5$ and $R_6$, $R_6$ and $R_7$, or $R_4$ and $R_8$ may combine together to form a ring (e.g., cyclobutane, cyclohexane, cycloheptane, cyclohexene, pyrrolidine, or pyperidine).

A most preferable example of the heterocyclic group represented by formula (Y-1) is a heterocyclic group in which Z is $-O-CR_4(R_5)-$, $-NR_6-CR_4(R_5)-$, or $-NR_6-NR_7-$ in formula (Y-1). The C number of a heterocyclic group represented by formula (Y-1) is 2 to 30, preferably 4 to 20, and more preferably 5 to 16.

Formula (Y-2)

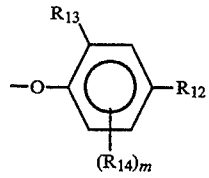

wherein at least one of $R_{12}$ and $R_{13}$ may be a group selected from a halogen atom, a cyano group, a nitro group, a trifluoromethyl group, a carboxyl group, an alkoxycarbonyl group, a carbonamide group, a sulfonamide group, a carbamoyl group, a sulfamayl group, an alkylsulfonyl group, an arylsulfonyl group, and an acyl group, and the other may be a hydrogen atom, an alkyl group, or an alkoxy group. $R_{14}$ represents a group having the same meaning as $R_{12}$ or $R_{13}$. m represents an integer of 0 to 2. The C number of an aryloxy group represented by formula (Y-2) is 6 to 30, preferably 6 to 24, and more preferably 6 to 15.

Formula (Y-3)

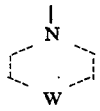

wherein W represents a nonmetallic atom group required to form, together with N, a pyrrole ring, a pyrazole ring, an imidazole ring, or a triazole ring. A ring represented by formula (Y-3) may have a substituent. Preferable examples of the substituent are a halogen atom, a nitro group, a cyano group, an alkoxycarbonyl group, an alkyl group, an aryl group, an amino group, an alkoxy group, an aryloxy group, or a carbamoyl group. The C number of a heterocyclic group represented by (Y-3) is 2 to 30, preferably 2 to 24, and more preferably 2 to 16.

X is most preferably a group represented by formula (Y-1).

A coupler represented by formula (Y) may form dimers or higher polymers, which combine together via a divalent group or a higher multivalent group, at the substituent $R_1$, Q, x, or:

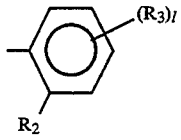

In this case, the number of carbon atoms described above in each substituent may fall outside the defined range.

Practical examples of each substituent in formula (Y) will be described below.

① followings are examples of 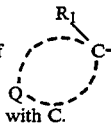 group which is formed by $R_1$ and Q together with C.

-continued
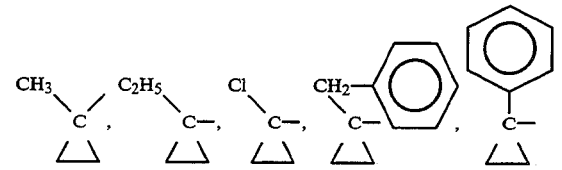
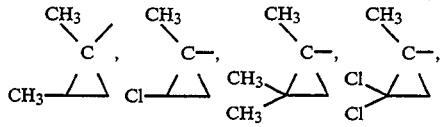
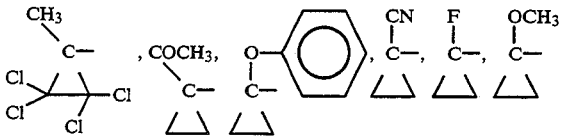
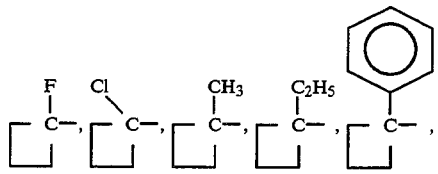
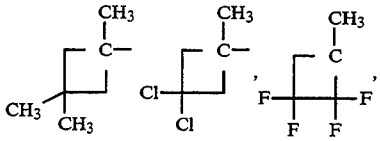
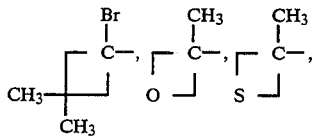
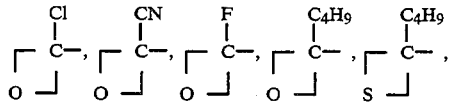
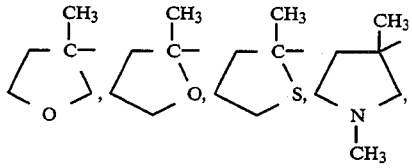
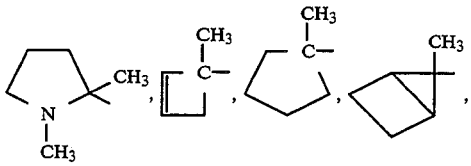
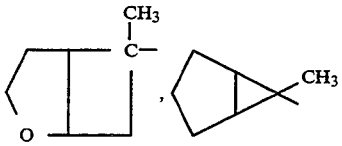
② in case of $R_2$
-continued
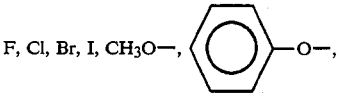
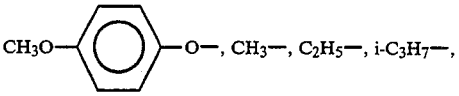
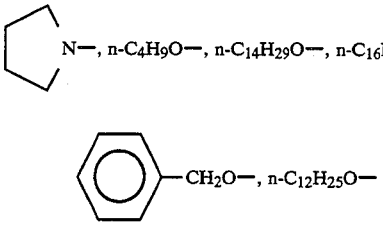
③ in case of $R_3$
F, Cl, Br, I, $CH_3O$—, $C_2H_5O$—, n-$C_{12}H_{25}O$—, $CH_3$,
t-$C_4H_9$—, —$COOCH_3$, $COOC_2H_5$, —$COOC_4H_9$-n,
$COOC_{12}H_{25}$-n, $OCH_2CH(C_6H_{13}\text{-n})C_8H_{17}$-n, —$COOCH(CH_3)COOC_{12}H_{25}$-n,
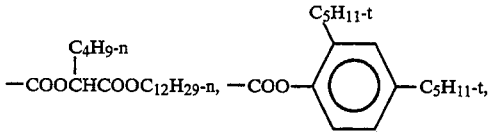
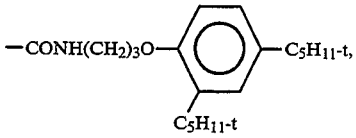
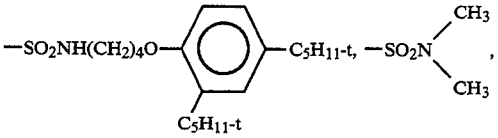
—$SO_2NHCOC_2H_5$, —$SO_2NHC_{16}H_{33}$-n, —$NHCOC_{13}H_{27}$-n,
—$NHCOC_{15}H_{31}$-n, —$NHCOC_{17}H_{35}$-n, —$NHCOCH(C_6H_{13}\text{-n})C_8H_{17}$-n,
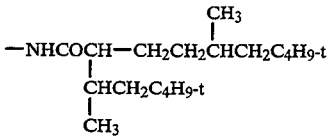
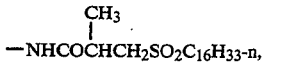
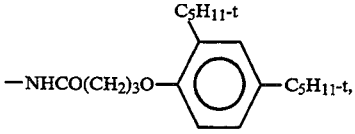

-continued
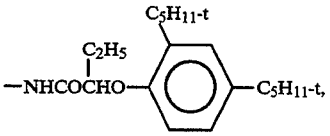
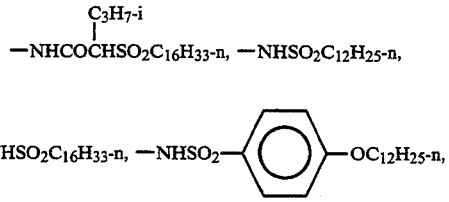
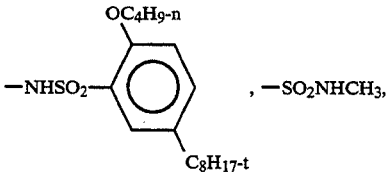
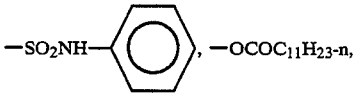
$-OSO_2C_{12}H_{25}$-n, $-NHCOOC_{12}H_{25}$-n
④ Example X
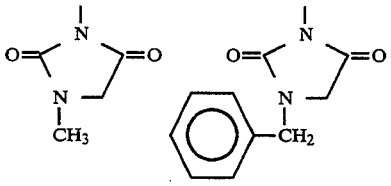
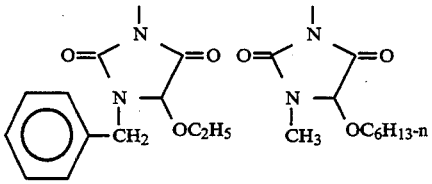
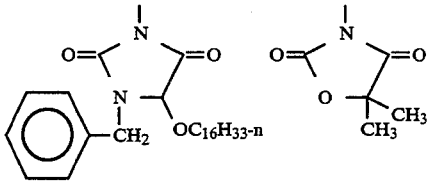
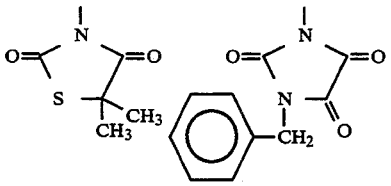
-continued
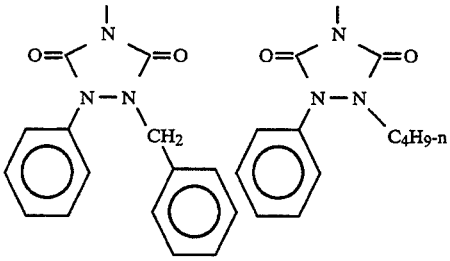
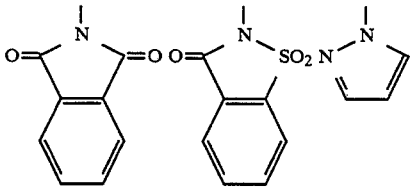
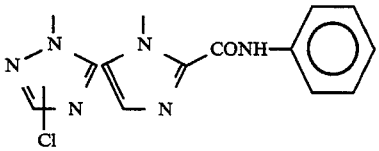
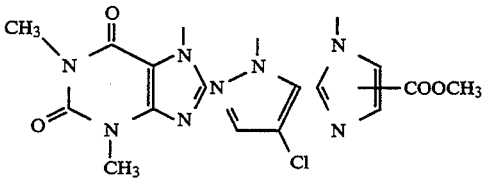
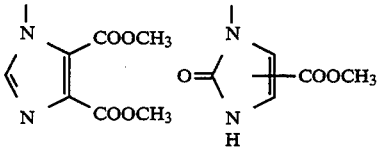
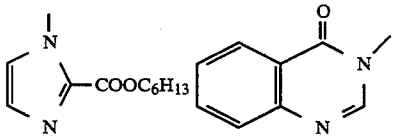
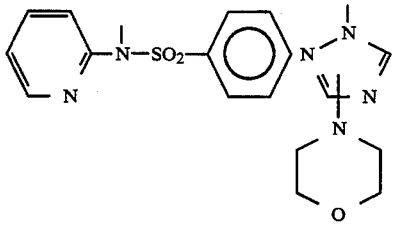
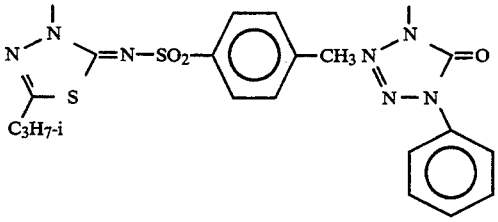

-continued
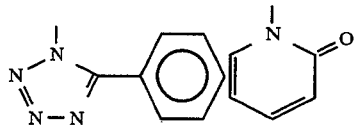
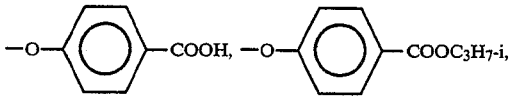
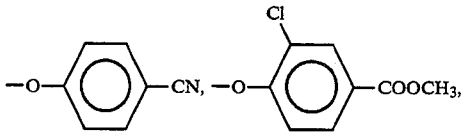
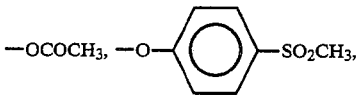
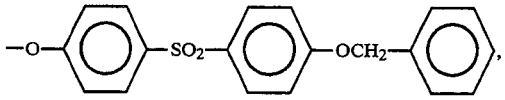
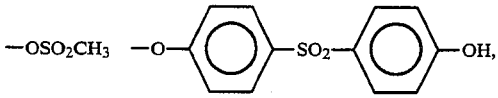
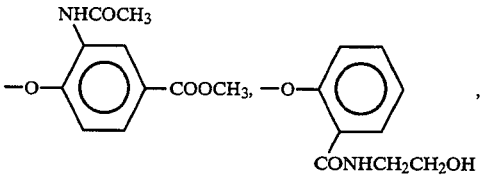
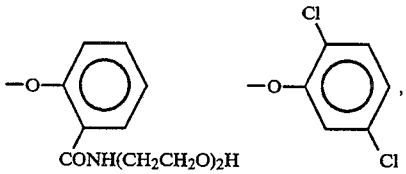
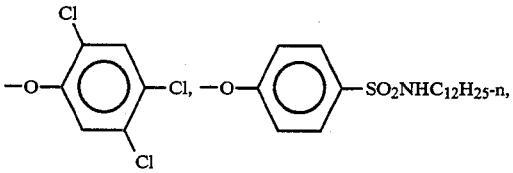
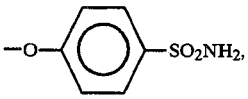
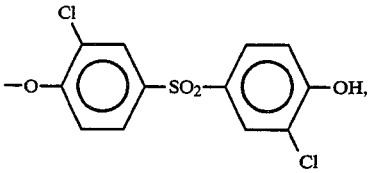
-continued
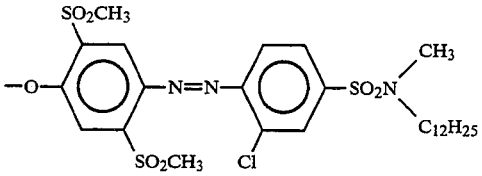
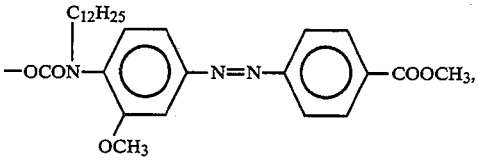
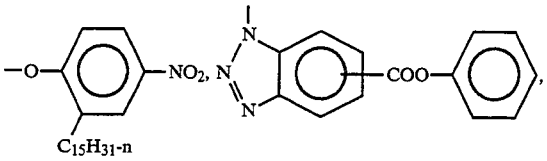
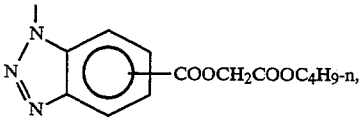
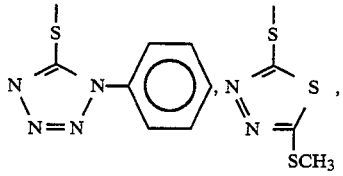
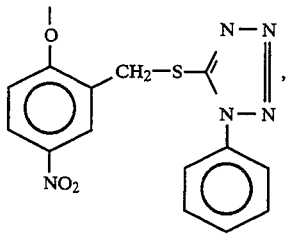
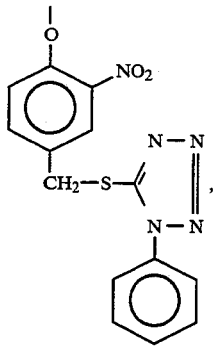

-continued
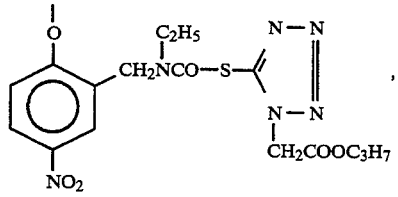
Practical examples of a yellow coupler represented by formula [Y] will be presented below.
Y-1
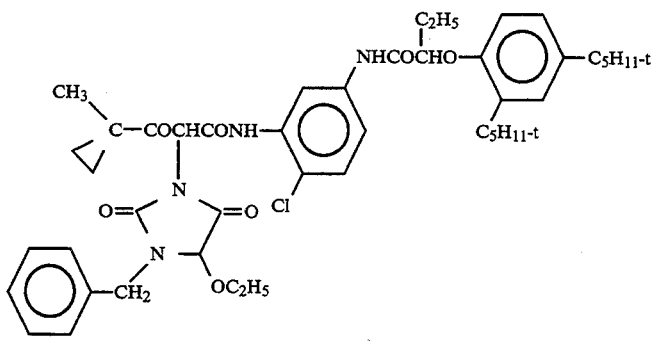
Y-2
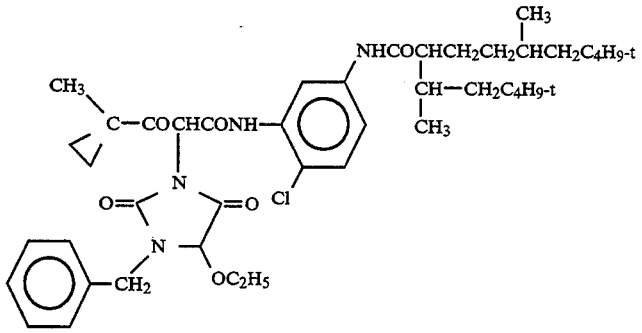
Y-3
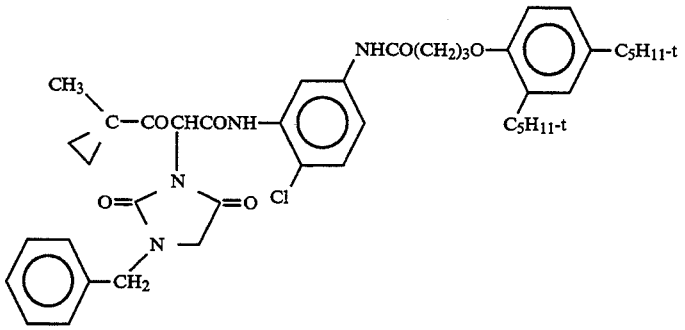
Y-4
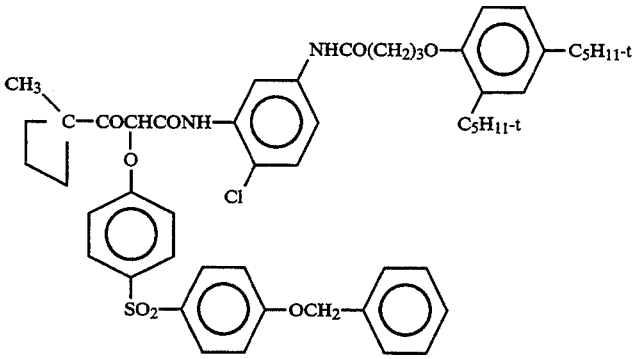

-continued
Y-5
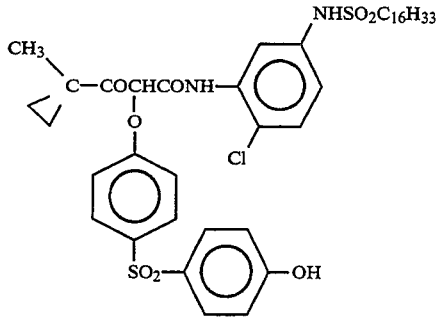
Y-6
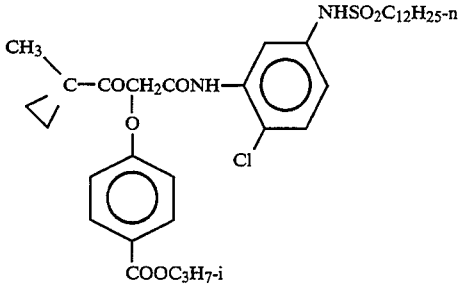
Y-7
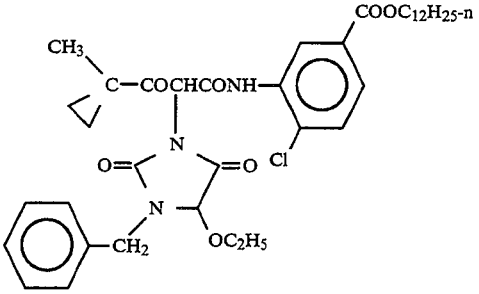
Y-8
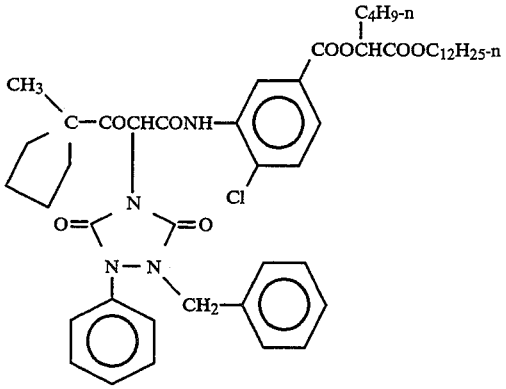
Y-9
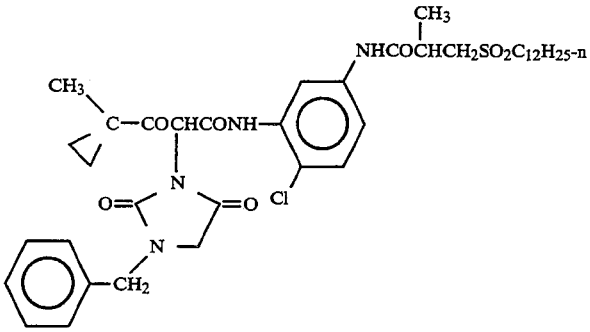

-continued
Y-10
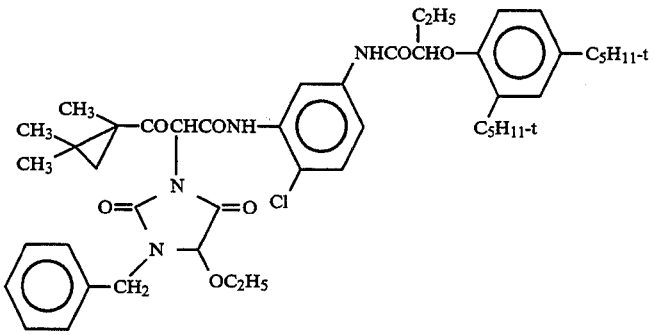
Y-11
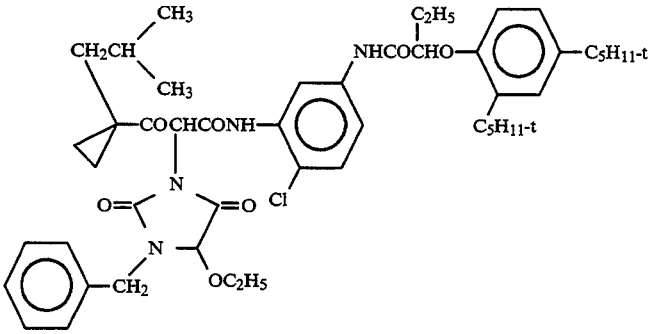
Y-12
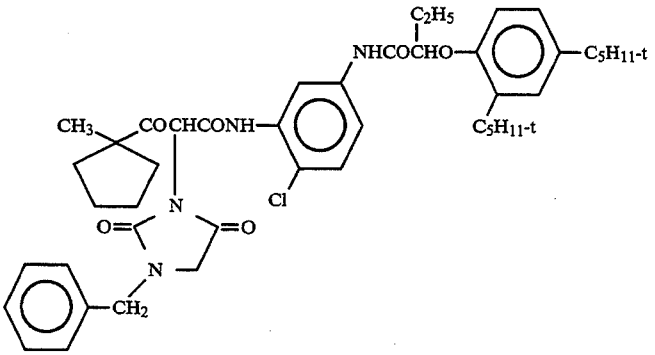
Y-13
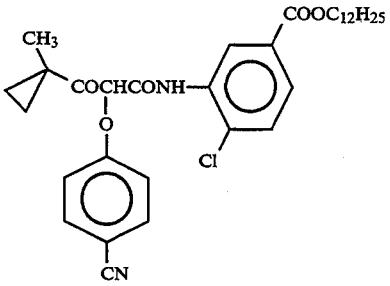
Y-14
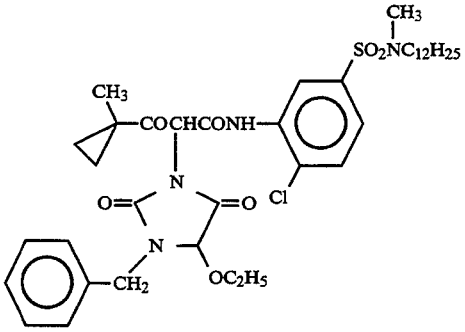

-continued
Y-15
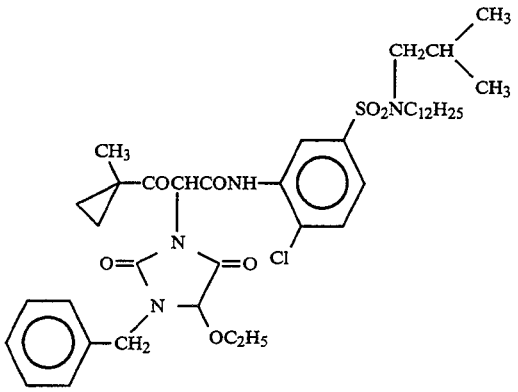
Y-16
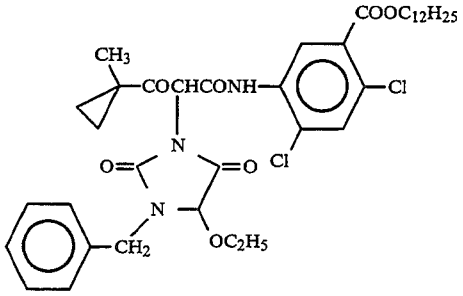
Y-17
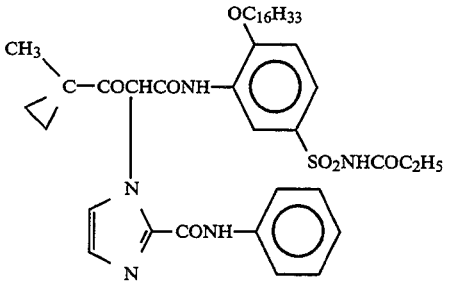
Y-18
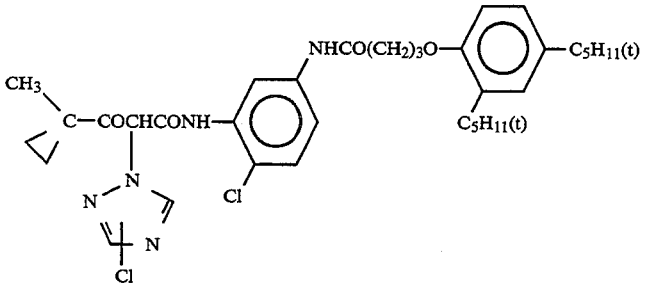
Y-19
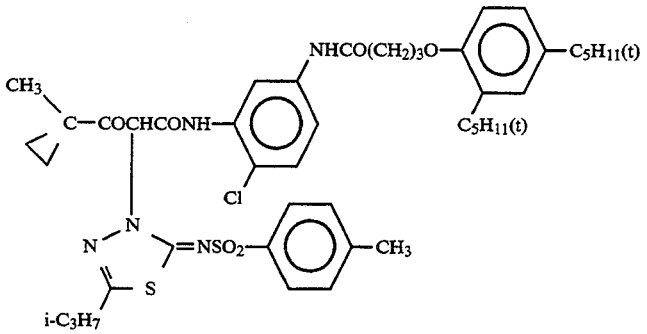

-continued
Y-20
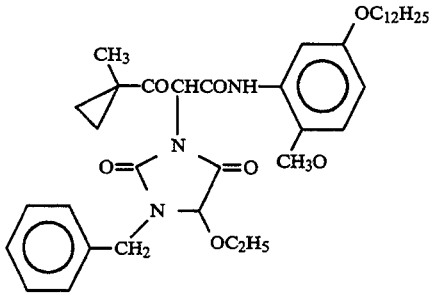
Y-21
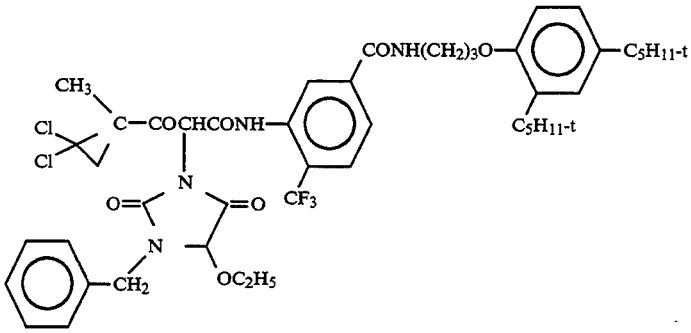
Y-22
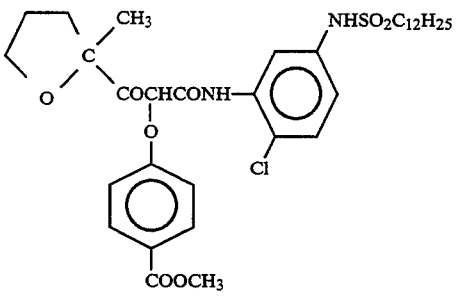
Y-23
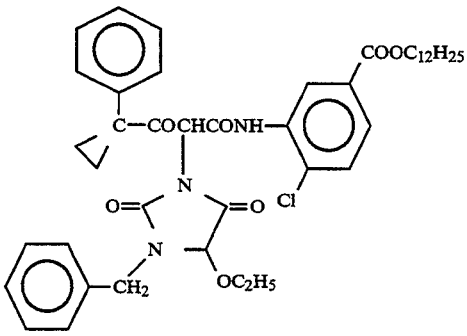
Y-24
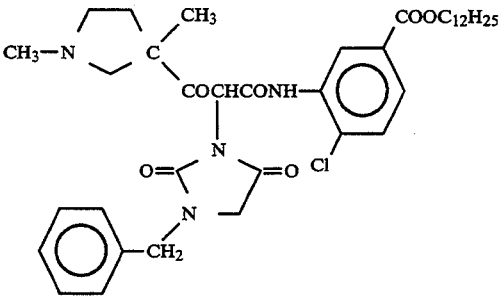

-continued
Y-25
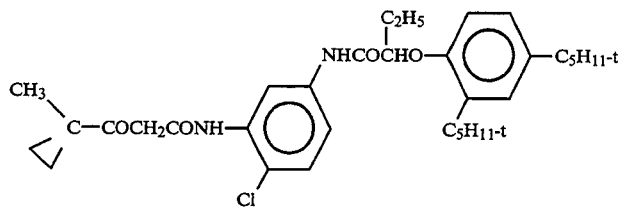
Y-26
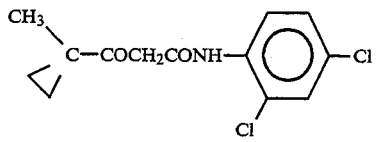
Y-27
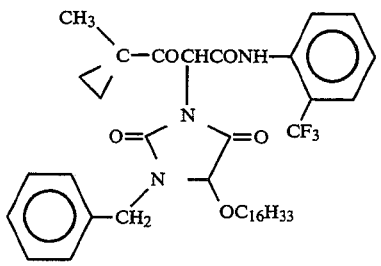
Y-28
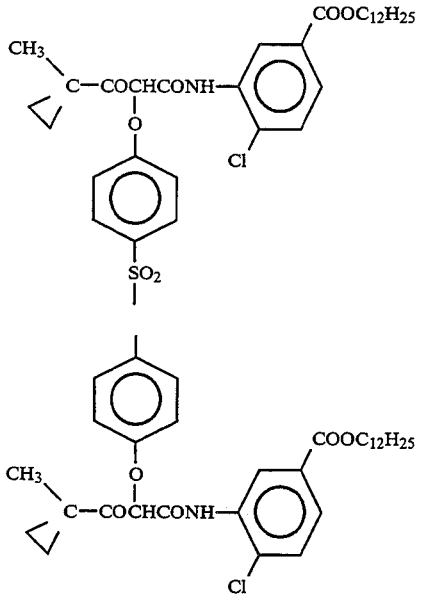
Y-29
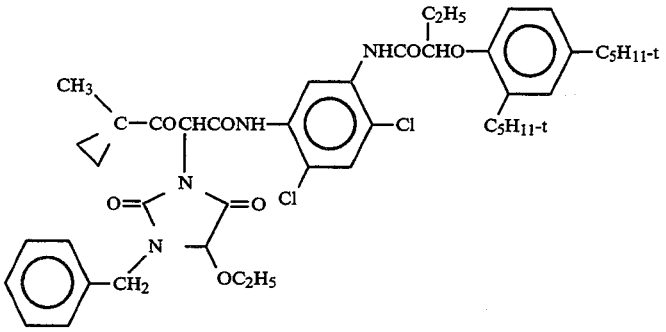

-continued
Y-30
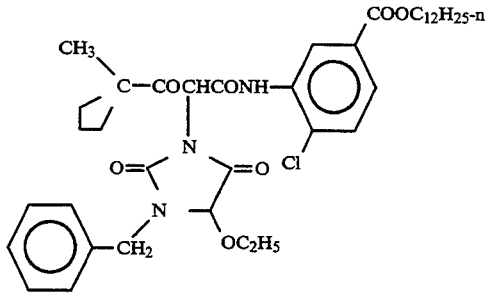
Y-31
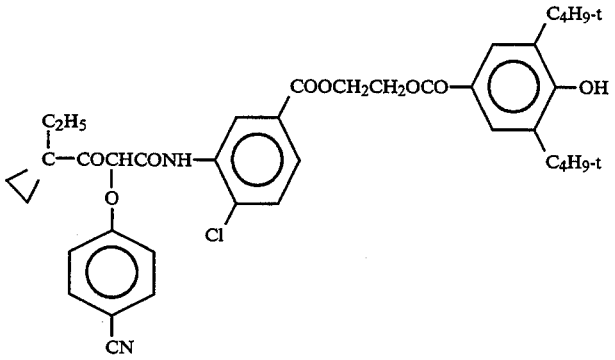
Y-32
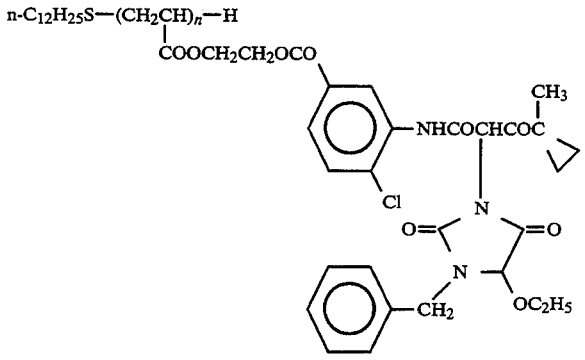
n = 3 (average value)
Y-33
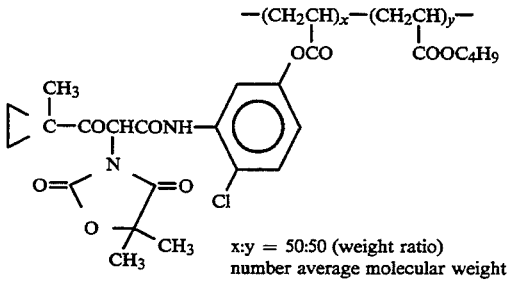
x:y = 50:50 (weight ratio)
number average molecular weight 50,000

-continued
Y-34
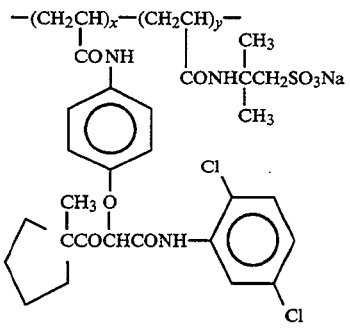
x:y = 80:20 (weight ratio)
number average molecular weight
Y-35
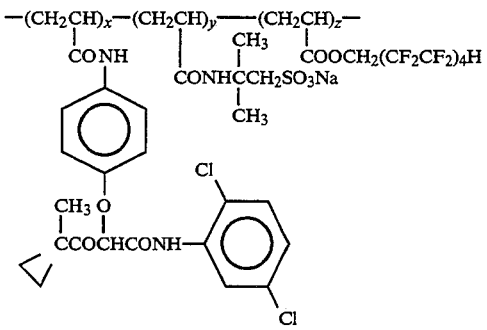
x:y:z = 50:30:20 (weight ratio)
number average molecular weight 70,000
Y-36
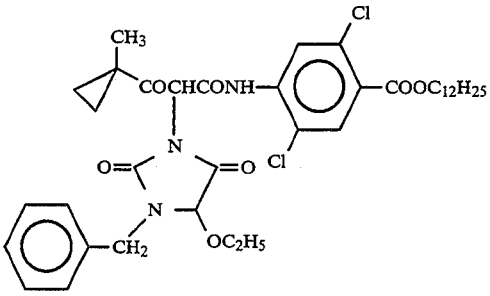
Y-37
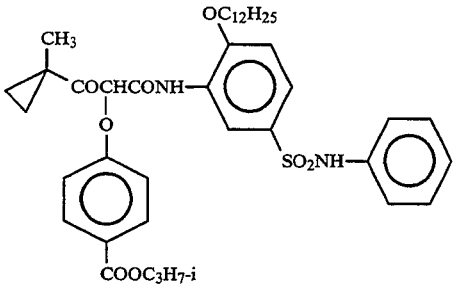
Y-38
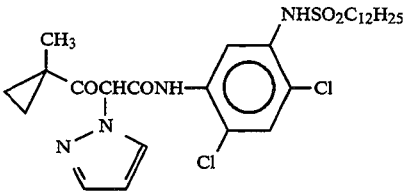

-continued
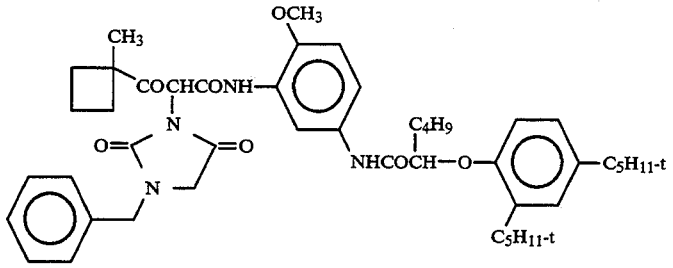
Y-39
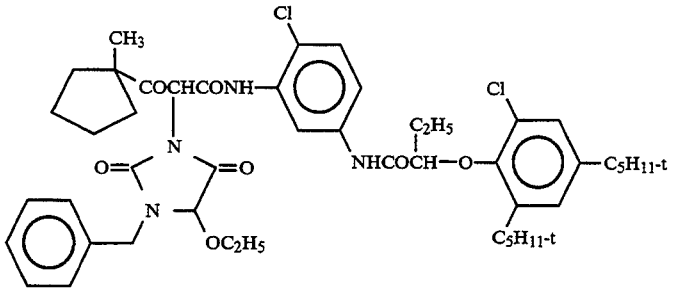
Y-40
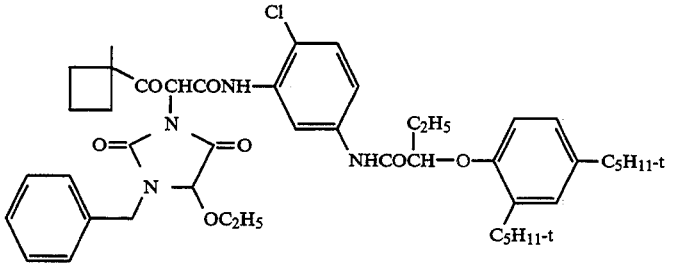
Y-41
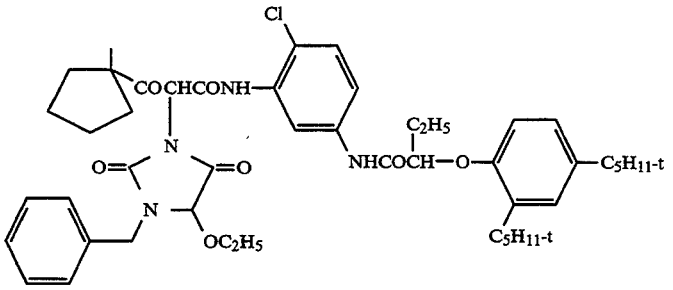
Y-42
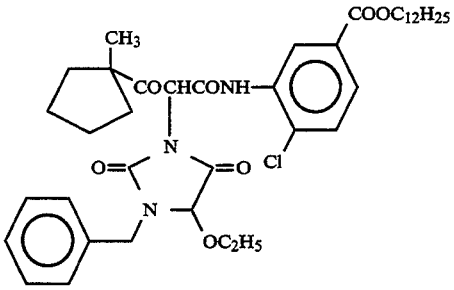
Y-43

-continued
Y-44
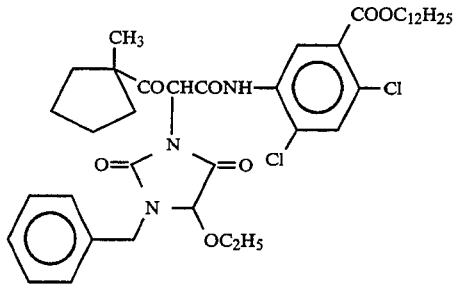
Y-45
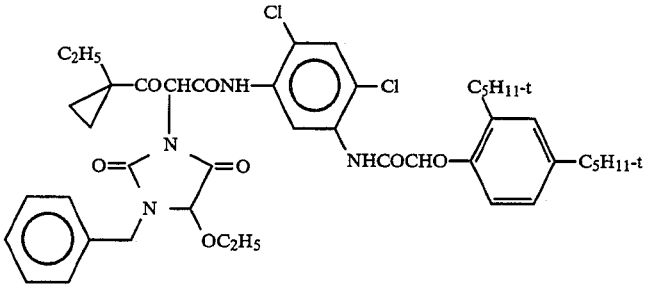
Y-46
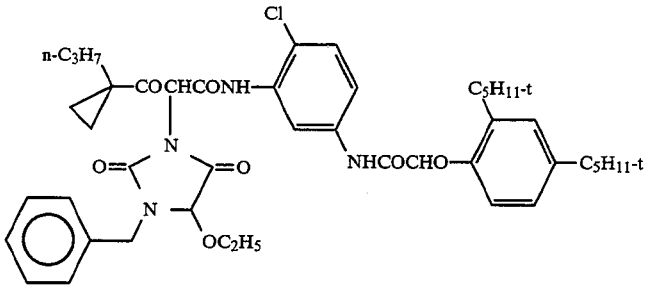
Y-47
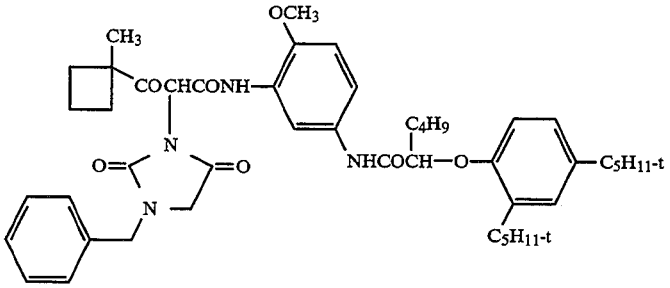
Y-48
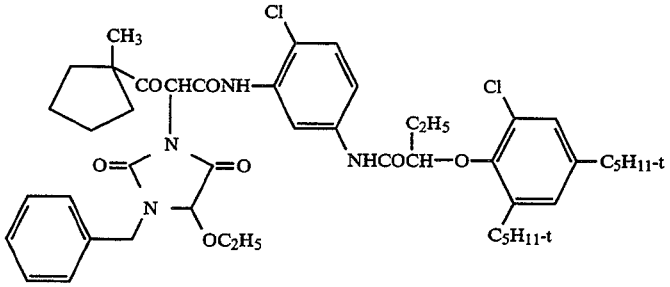

-continued
Y-49
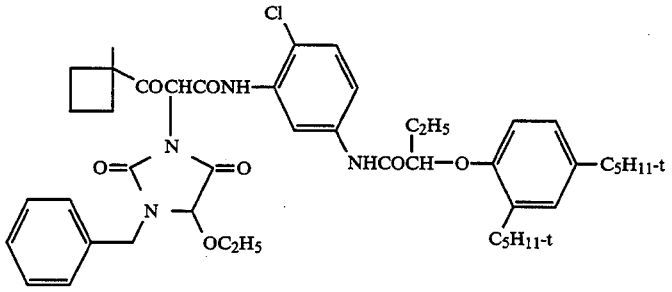
Y-50
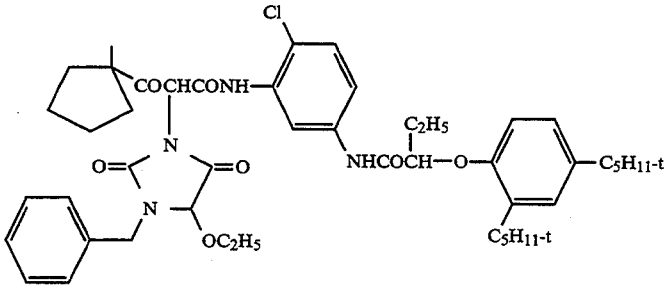
Y-51
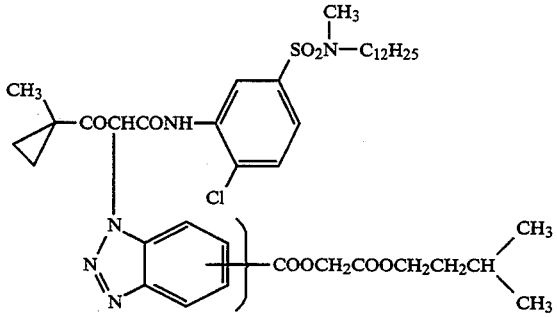
Y-52
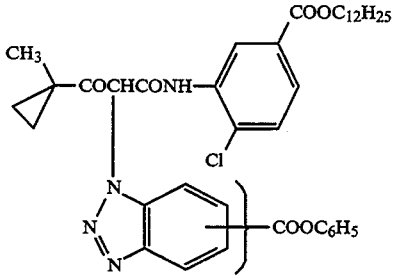
Y-53
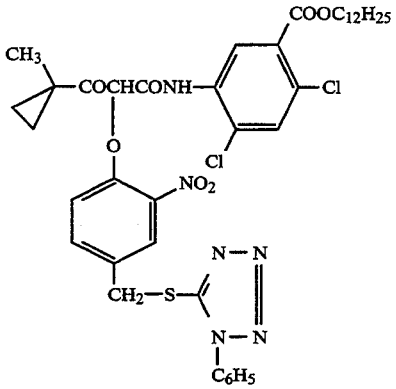

-continued

Y-54

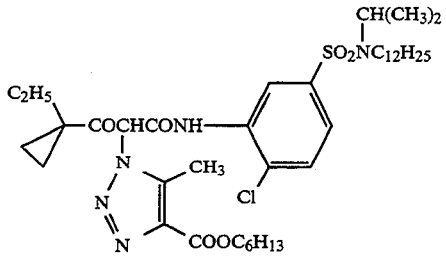

The yellow coupler of the present invention represented by formula (Y) can be synthesized by the following synthesis route:

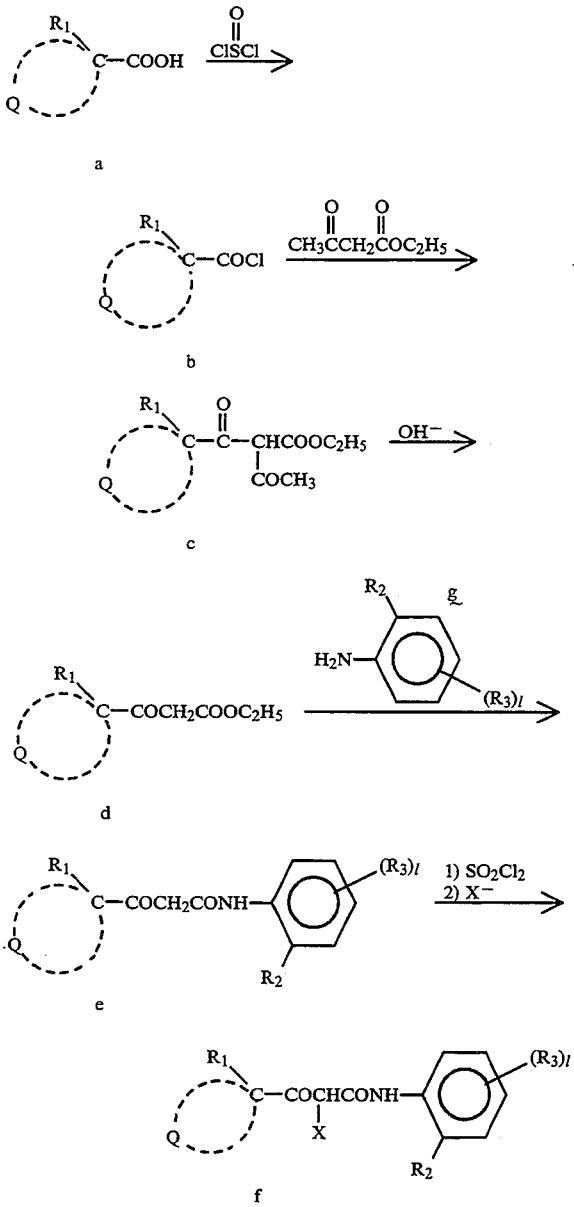

The compound a is synthesized by methods described in, e.g., J. Chem. Soc. (C), 1968, 2548, J. Am. Chem. Soc., 1934, 56, 2710, Synthesis, 1971, 258, J. Org. Chem., 1978, 43, 1729, CA, 1960, 66, 18533y.

The synthesis of the compound b is performed by using thionyl chloride or oxalyl chloride in the absence of a solvent or in a solvent such as methylene chloride, chloroform, carbon tetrachloride, dichloroethane, toluene, N,N-dimethylformamide, or N,N-dimethylacetamide. The reaction temperature is −20° C. to 150° C., and preferably −10° C. to 80° C.

The compound c is synthesized by converting ethyl acetoacetate into an anion by using, e.g., magnesium methoxide and adding the compound b to the anion. The reaction is performed in the absence of a solvent or by using tetrahydrofuran or ethylether, and the reaction temperature is normally −20° C. to 60° C., and preferably −10° C. to 30° C. The compound d is synthesized by reacting the compound c with a base, such as ammonia water, an aqueous $NaHCO_3$ solution, or an aqueous sodium hydroxide solution, in the absence of a solvent or in a solvent such as methanol, ethanol, or acetonitrile. The reaction temperature is normally −20° C. to 50° C., and preferably −10° C. to 30° C.

The compound e is synthesized by reacting the compounds d and g in the absence of a solvent. The reaction temperature is normally 100° C. to 150° C., and preferably 100° C. to 120° C. If X is not H, the split-off group X is introduced to synthesize the compound f after chlorination or bromination. The compound e is formed into a chloro substitution product by using, e.g., sulfuryl chloride or N-chlorosuccinimide or into a bromo substitution product by using, e.g., bromine or N-bromosuccinimide in a solvent such as dichloroethane, carbon tetrachloride, chloroform, methylene chloride, or tetrahydrofuran. At this time, the reaction temperature is −20° C. to 70° C., and preferably −10° C. to 50° C.

The coupler f of the present invention can be obtained by reacting the chloro substitution product or the bromo substitution product with a proton adduct H—X of a split-off group in a solvent such as methylene chloride, chloroform, tetrahydrofuran, acetone, acetonitrile, dioxane, N-methylpyrrolidone, N,N'-dimethylimidazolidine-2-one, N,N-dimethylformamide, or N,N-dimethylacetamide at a reaction temperature of −20° C. to 150° C., and preferably −10° C. to 100° C. At this time, it is possible to use a base such as triethylamine, N-ethylmorpholine, tetramethylguanidine, potassium carbonate, sodium hydroxide, or sodium bicarbonate.

Synthesis examples of the couplers of the present invention will be described below.

Synthesis Example 1

Synthesis of exemplified compound Y-25

38.1 g of oxalylchloride were dropped in a mixture of 25 g of 1-methylcyclopropanecarboxylic acid synthesized by the method described in Gotkis, D. et. al., J. Am. Chem. Soc., 1934, 56, 2710, 100 ml of methylene chloride, and 1 ml of N,N-dimethylformamide, at room temperature over 30 minutes. After the dropping, the resultant mixture was reacted at room temperature for two hours, and the methylene chloride and an excess of oxalylchloride were removed under reduced pressure obtained by an aspirator. The result was an oily product of 1-methylcyclopropanecarbonylchloride.

100 ml of methanol were dropped in a mixture of 6 g of magnesium and 2 ml of carbon tetrachloride at room temperature over 30 minutes. The resultant mixture was heated under reflux for two hours, and 32.6 g of ethyl 3-oxobutyrate were dropped under heated reflux over 30 minutes. After the dropping, further reflux was conducted for 2 hours, then the methanol was perfectly distilled off under reduced pressure obtained by an aspirator. 100 ml of tetrahydrofuran were dispersed in the reaction product, and the 1-methylcyclopropanecarbonylchloride obtained above was dropped at room temperature. After the reaction was continued for 30 minutes, the reaction solution was extracted with 300 ml of ethyl acetate and diluted sulfuric acid. The organic layer was washed with water and dried by sodium sulfate anhydride. Thereafter, the solvent was distilled off to obtain 55.3 g of an oily product of ethyl 2-(1-methylcyclopropanecarbonyl)-3-oxobutyrate.

A solution of 55 g of the ethyl 2-(1-methylcyclopropanecarbonyl)-3-oxobutyrate and 160 ml of ethanol was stirred at room temperature, and 60 ml of 30% ammonia water were dropped in the solution over 10 minutes. The resultant solution was stirred for one hour and extracted with 300 ml of ethyl acetate and diluted hydrochloric acid. After neutralized and washed with water, the organic layer was dried by sodium sulfate anhydride, and the solvent was distilled off. The result was 43 g of an oily product of ethyl (1-methylcyclopropanecarbonyl)acetate.

34 g of the ethyl (1-methylcyclopropanecarbonyl-)acetate and 44.5 g of N-(3-amino-4-chlorophenyl)-2-(2,4-di-t-pentylphenoxy)butaneamide were heated under reflux at an internal temperature of 100° C. to 120° C. under reduced pressure obtained by an aspirator. After the reaction was continued for four hours, the reaction solution was purified through a column chromatography using a solvent mixture of n-hexane and ethyl acetate to obtain 49 g of a viscous oily product of exemplified compound Y-30. The structure of the compound was confirmed by an MS spectrum, an NMR spectrum, and elemental analysis.

Synthesis Example 2

Synthesis of exemplified compound Y-1

22.8 g of exemplified compound Y-25 were dissolved in 300 ml of methylene chloride, and 5.4 g of sulfuryl chloride were dropped under ice cooling over 10 minutes. After the reaction was continued for 30 minutes, the reaction solution was washed well with water. The resultant solution was dried by sodium sulfate anhydride and condensed to obtain a chloride of exemplified compound Y-25. This chloride of exemplified compound Y-25 was dissolved in 50 ml of N,N-dimethylformaldehyde, and the resultant solution was dropped in a solution of 18.7 g of 1-benzyl-5-ethoxyhydantoin, 11.2 ml of triethylamine, and 500 ml of N,N-dimethylformamide at room temperature over 30 minutes.

Thereafter, the reaction was continued at 40° C. for four hours, and the reaction solution was extracted with 300 ml of ethyl acetate. After washed with water, the resultant material was washed with 300 ml of a 2% aqueous triethylamine solution and neutralized by diluted hydrochloric acid. After the organic layer was dried by sodium sulfate anhydride, the solvent was distilled off to obtain an oily product. This oily product was crystallized from a solvent mixture of n-hexane and ethyl acetate. The precipitated crystals were filtered out, washed with a solvent mixture of n-hexane and ethyl acetate, and dried. As a result, 22.8 g of crystals of exemplified compound Y-1 were obtained.

The structure of the compound was confirmed by an MS spectrum, an NMR spectrum, and elemental analysis. The melting point was 132° C. to 133° C.

The amount of the coupler of the present invention to be added to emulsion layers is preferably $1\times10^{-3}$ to 2 mol, and more preferably $2\times10^{-2}$ to 0.6 mol per mol of a silver halide in a light-sensitive layer where the coupler of the present invention is used.

Various well-known dispersion methods are used to introduce a coupler represented by formula [I], couplers usable in a light-sensitive material of the present invention to be described later, for other lipophilic photographic organic compounds into the light-sensitive material.

In the oil-in-water dispersion method described in, e.g., U.S. Pat. No. 2,322,027, a lipophilic photographic organic compound is dissolved by using a high boiling point organic solvent having a boiling point of about 175° C. or more at normal pressure and/or a low boiling point organic solvent having a boiling point of about 30° C. to about 160° C. at normal pressure, and emulsion dispersed in a hydrophilic colloid such as gelatin. Examples of the high boiling point organic solvent are phthalate esters, phosphate esters, benzoate esters, fatty esters, amides, phenols, alcohols, carboxylic acids, N,N-dialkylanilines, hydrocarbons, oligomers, and polymers. Examples of the low boiling point organic solvent are esters (e.g., ethylacetate, butylacetate, ethylpropionate, β-ethoxyethylacetate, and methylcellosolveacetate), alcohols (e.g., secondary butylalcohol), ketones (e.g., methylisobutylketone, methylethylketone, and cyclohexane), amides (e.g., dimethylformamide and N-methylpyrrolidone), and ethers (e.g., tetrahydrofuran and dioxane).

The steps and effects of a latex dispersion method 10 and practical examples of a latex for impregnation are described in, e.g., U.S. Pat. No. 4,199,363, West German Patent Applications (OLS) 2,541,274 and 2,541,230, and EP 294,104A. It is possible to impart not only a function as a dispersion medium but also other various functions of, e.g., improving the physical properties of a gelatin film, accelerating color formation, controlling the hue of a color dye, and improving a dye stability, to the high boiling organic solvents or the latexes. The high boiling organic solvent can be used in the form of any of a liquid, a wax, and a solid, and is preferably represented by formulas (S-1) to (S-9) below.

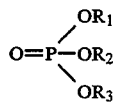

formula [S-1]

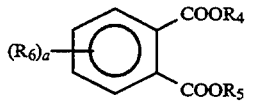

formula [S-2]

-continued $(Ar-COO)_b-R_7$ formula [S-3]

$(R_8-COO)_c-R_9$ formula [S-4]

$R_{10}(COO-R_{11})_d$ formula [S-5]

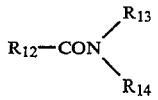
formula [S-6]

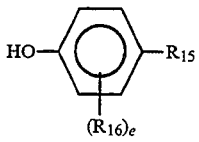
formula [S-7]

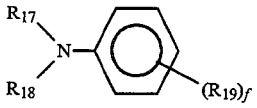
formula [S-8]

$-(A_1)_{a1}-(A_2)_{a2}-(A_n)_{an}$ formula [S-9]

In formula (S-1), each of $R_1$, $R_2$, and $R_3$ independently represents an alkyl group, a cycloalkyl group, or an aryl group.

In formula (S-2), each of $R_4$ and $R_5$ independently represents an alkyl group, a cycloalkyl group, or an aryl group, $R_6$ represents a halogen atom (F, Cl, Br, or I; this will be the same in the following description), an alkyl group, an alkoxy group, an aryloxy group, or an alkoxycarbonyl group, and a represents an integer of 0 to 3. If a represents a plural number, a plurality of $R_6$'s may be the same or different.

In formula (S-3), Ar represents an aryl group, b represents an integer of 1 to 6, and $R_7$ represents a bivalent hydrocarbon group or hydrocarbon groups which combine together by an ether bond.

In formula (S-4), $R_8$ represents an alkyl group or a cycloalkyl group, c represents an integer of 1 to 6, and $R_9$ represents a c-valent hydrocarbon group or hydrocarbon groups which combine together by an ether bond.

In formula (S-5), d represents an integer of 2 to 6, $R_{10}$ represents a d-valent hydrocarbon group (except for an aromatic group), and $R^{11}$ represents an alkyl group, a cycloalkyl group, or an aryl group.

In formula (S-6), each of $R_{12}$, $R_{13}$, and $R_{14}$ independently represents an alkyl group, a cycloalkyl group, or an aryl group. $R_{12}$ and $R_{13}$ or $R_{13}$ and $R_{14}$ may combine together to form a ring.

In formula (S-7), $R_{15}$ represents an alkyl group, a cycloalkyl group, an alkoxycarbonyl group, an alkylsulfonyl group, an arylsulfonyl group, an aryl group, or a cyano group, $R_{16}$ represents a halogen atom, an alkyl group, a cycloalkyl group, an aryl group, an alkoxy group, or an aryloxy group, and e represents an integer of 0 to 3. If e represents a plural number, a plurality of $R_{16}$'s may be the same or different.

In formula (S-8), each of $R_{17}$ and $R_{18}$ independently represents an alkyl group, a cycloalkyl group, or an aryl group, $R_{19}$ represents a halogen atom, an alkyl group, a cycloalkyl group, an aryl group, an alkoxy group, or an aryloxy group, and f represents an integer of 0 to 4. If f represents a plural number, a plurality of $R_{19}$'s may be the same or different.

In formula (S-9), $A_1$, $A_2$, . . . , $A_n$ represent polymerization units derived from different non-color-forming ethylene monomers, $a_1$, $a_2$, . . . , $a_n$ represent weight fractions of the respective polymerization units, and n represents an integer of 1 to 30.

Practical examples of the high boiling point organic solvent used in the present invention will be presented below.

S-1

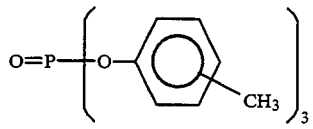

S-2

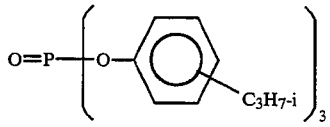

S-3

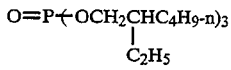

S-4

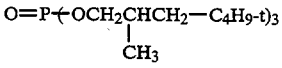

S-5

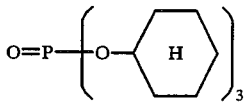

S-6

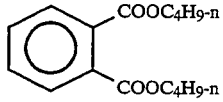

S-7

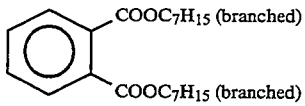

S-8

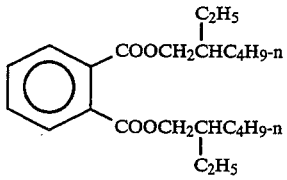

S-9

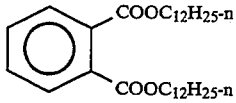

S-10

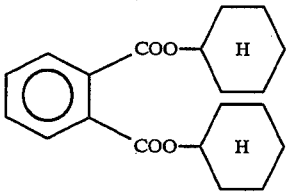

-continued

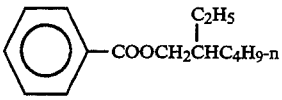

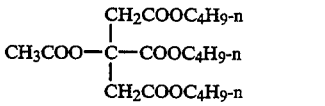

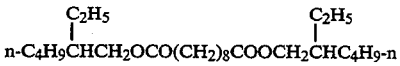

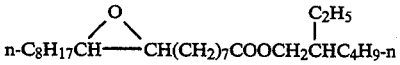

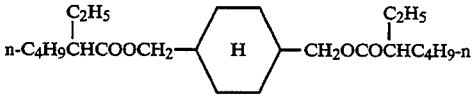

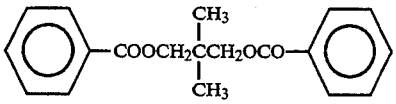

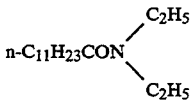

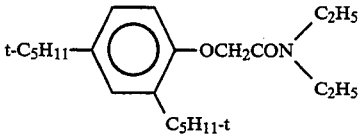

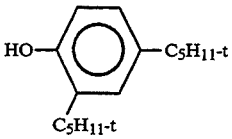

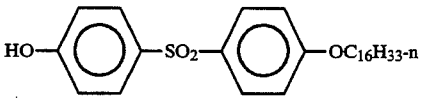

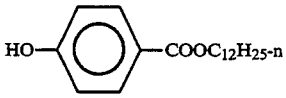

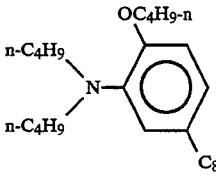

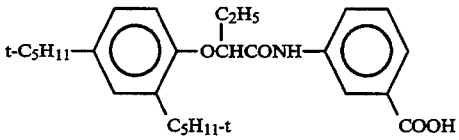

-continued

| | | |
|---|---|---|
| S-11 | ploymethylmethacrylate (average molecular weight 20,000) | S-24 |
| | poly (N-t-butylarylamide) (average molecular weight 60,000) | S-25 |
| S-12 | chlorinated paraffin (average composition $C_{12}H_{18}Cl_8$) | S-26 |

Compound examples of the high boiling organic solvent of the present invention except for those described above and/or methods of synthesizing these high boiling organic solvents are described in, e.g., U.S. Pat. Nos. 2,322,027, 2,533,514, 2,772,163, 2,835,579, 3,676,137, 3,912,515, 3,936,303, 4,080,209, 4,127,413, 4,193,802, 4,239,851, 4,278,757, 4,363,873, 4,483,918, and 4,745,049, EP 276,319A, JP-A-48-47335, JP-A-51-149028, JP-A-61-84641, JP-A-62-118345, JP-A-62-247364, JP-A-63-167357, JP-A-64-68745, and JP-A-1-101543.

The amount of the high boiling organic solvent of the present invention is, in weight ratio, preferably 0.3 or less, and more preferably 0.1 or less in terms of an improvement in sharpness, with respect to couplers used in each light-sensitive layer. Note that it is not necessary to use any high boiling organic solvent.

The present invention can be applied to a color light-sensitive material. The light-sensitive material of the present invention need only have at least one of silver halide emulsion layers, i.e., a blue-sensitive layer, a green-sensitive layer, and a red-sensitive layer formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different speed. In a multilayered silver halide color photographic light-sensitive material, the light-sensitive layers are unit light-sensitive layer sensitive to blue, green or red. The unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-sensitivity emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-sensitivity emulsion layer is formed remotely from a support and a high-sensitivity layer is formed close to the support.

More specifically, layers may be arranged from the farthest side from a support in an order of low-sensitivity blue-sensitive layer (BL)/high-sensitivity blue-sensitive layer (BH)/high-sensitivity green-sensitive layer (GH)/low-sensitivity green-sensitive layer (GL)/high-sensitivity red-sensitive layer (RH)/low-sensitivity red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-B-56-25738 and JP-B-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-sensitivity emulsion layer/high-sensitivity emulsion layer/low-sensitivity emulsion layer from the farthest side from a support in a layer sensitive to one color as described in JP-A-59-202464.

In addition, an order of high-sensitivity emulsion layer/low-sensitivity emulsion layer/medium-sensitivity emulsion layer or low-sensitivity emulsion layer/medium-sensitivity emulsion layer/high-sensitivity emulsion layer may be adopted.

Furthermore, the arrangement can be changed as described above even when four or more layers are formed.

As described above, various layer types and arrangements can be selected in accordance with the application of the light-sensitive material.

A preferable silver halide contained in photographic emulsion layers of the photographic light-sensitive material of the present invention is silver iodobromide, silver iodochloride, or silver iodochlorobromide containing about 30 mol % or less of silver iodide. The most preferable silver halide is silver iodobromide or silver iodochlorobromide containing about 2 mol % to about 10 mol % of silver iodide.

Silver halide grains contained in the photographic emulsion may have regular crystals such as cubic, octahedral, or tetradecahedral crystals,! irregular crystals such as spherical or tabular crystals, crystals having crystal defects such as twinned crystal faces, or composite shapes thereof.

The silver halide may consist of fine grains having a grain size of about 0.2 μm or less or large grains having a projected area diameter of about 10 μm, and the emulsion may be either a polydisperse or monodisperse emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,499,520, and British Patent 2,112,157.

The crystal structure may be uniform, may have different halogen compositions in the interior and the surface layer thereof, or may be a layered structure. Alternatively, a silver halide having a different composition may be bonded by an epitaxial junction or a compound except for a silver halide such as silver rhodanide or zinc oxide may be bonded. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of an internally fogged core/shell type silver halide grain may have the same halogen composition as or a different halogen composition from that of the other portion. Examples of the internally fogged or surface-fogged silver halide are silver chloride, silver chlorobromide, silver iodobromide, and silver chloroiodobromide. Although the grain size of these fogged silver halide grains is not particularly limited, an average grain size is 0.01 to 0.75 μm, and most preferably, 0.05 to 0.6 μm. The grain shape is also not particularly limited but may be a regular grain shape. Although the emulsion may be a polydisperse emulsion, it is preferably a monodisperse emulsion (in which at least 95% in weight or number of silver halide grains have a grain size falling within the range of ±40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive material silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table I.

TABLE I

| Additives | RD17643 Dec.,197B | RD18716 Nov.,1979 | RD307105 Nov.1989 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649. right column | pp. 868–870 |
| 6. Light absorbent. filter dye. ultraviolet absorbents | pp. 25–26 | page 649, right column to page 650. left column | page 873 |
| 7. Stain preventing agents | page 25, right column | page 650. left to right columns | page 872 |
| 8. Dye image stabilizer | page 25 | page 650, left column | page 872 |
| 9. Hardening agents | page 26 | page 651. left column | pp. 874–875 |
| 10. Binder | page 26 | page 651. left column | pp. 875–874 |

TABLE I-continued

| Additives | RD17643 Dec.,197B | RD18716 Nov.,1979 | RD307105 Nov.1989 |
|---|---|---|---|
| 11. Plasticizers. lubricants | page 27 | page 650, right column | page 876 |
| 12. Coating aids. surface active agents | pp. 26–27 | page 650, right column | pp. 875–876 |
| 13 Antistatic agents | page 27 | page 650, right column | pp. 876–877 |
| 14. Matting agent | | | pp. B78–879 |

In order to prevent degradation in photographic properties caused by formaldehyde gas, a compound which can react with and fix formaldehyde described in U.S. Pat. No. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317,308A, U.S. Pat. No. 4,420,555, and JP-A-1-259358.

Various color couplers can be used in the present invention, and specific examples of these couplers are described in patents described in above-mentioned Research Disclosure (RD), No. 17643, VII-C to VII-G and RD No. 307105, VII-C to VII-G.

Preferred examples of a yellow coupler are described in, e.g., U.S. Pat. Nos. 3933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,310,619 and 4,351,897, EP 73,636, U.S. Pat. Nos. 3,061,432 and 3,725,067, JP-A-60-35730, JP-A-55-118034, and JP-A-60-185951, U.S. Pat. No. 4,500,630, and WO No. 88/04795.

An example of a pyrazoloazole-based magenta coupler which is preferably used in the present invention is a magenta coupler represented by formula (II) below:

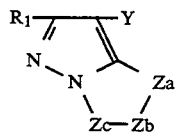

Formula (II)

wherein $R_1$ represents a hydrogen atom or a substituent, Y represents a hydrogen atom or a split-off group, each of $Z_a$, $Z_b$, and $Z_c$ represents methine, substituted methine, =N—, or —NH—, and one of a $Z_a$—$Z_b$ bond and a $Z_b$—$Z_c$ bond is a double bond while the other is a single bond. If the $Z_b$—$Z_c$ bond is a carbon-carbon double bond, this bond may be a part of an aromatic ring. $R_1$ or Y may form a dimer or a higher polymer. If $Z_a$, $Z_b$, or $Z_c$ is the substituted methine, this substituted methine may form a dimer or a higher polymer.

Pyrazoloazole-based couplers represented by formula (II) are well-known couplers. Of these pyrazoloazole-based couplers, imidazo[1,2-b]pyrazoles described in U.S. Pat. No. 4,500,630 are preferable, and pyrazolo[1,5-b][1,2,4]triazoles described in U.S. Pat. No. 4,540,654 are most preferable in terms of a small yellow sub-absorption of a color dye and a good light fastness.

Other preferable examples of the pyrazoloazole-based coupler are a pyrazolotriazole coupler as described in JP-A-61-65245, in which a branched alkyl group combines directly with the 2-, 3-, or 6-position of a pyrazolotriazole ring; a pyrazoloazole coupler described in JP-A-61-65246, which contains a sulfonamide group in a molecule; a pyrazoloazole coupler described in JP-A-61-147254, which has an alkoxyphenylsulfonamide-ballast group; and a pyrazolotriazole coupler described in EP 226,849 or 294,785, which has an alkoxy group or an aryloxy group at the 6-position.

Practical examples of a coupler represented by formula (II) will be presented below.

M-1

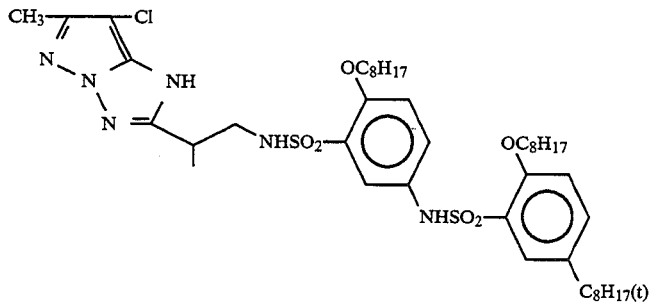

M-2

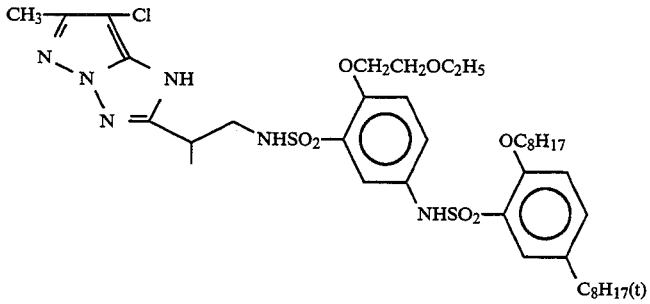

M-3

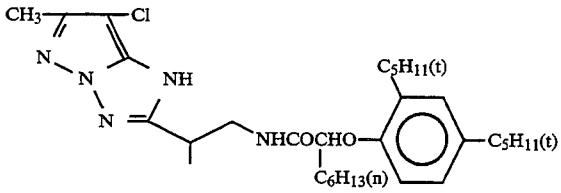

M-4

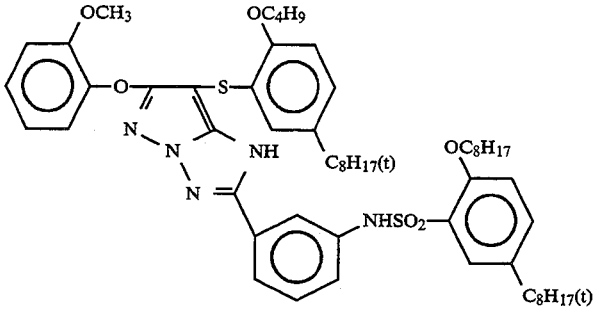

-continued
M-5
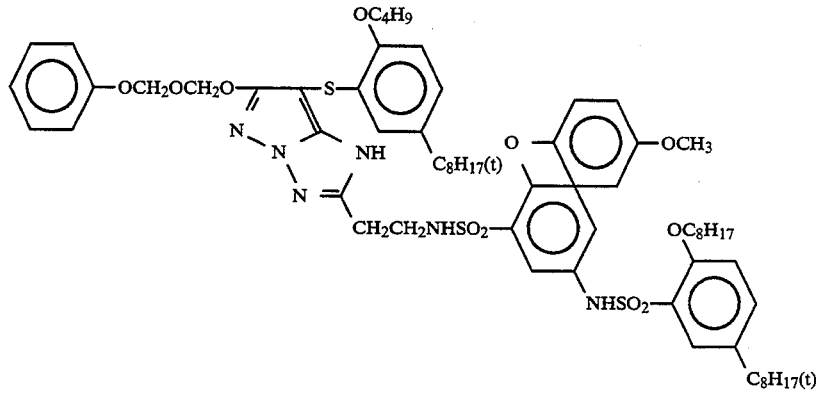
M-6
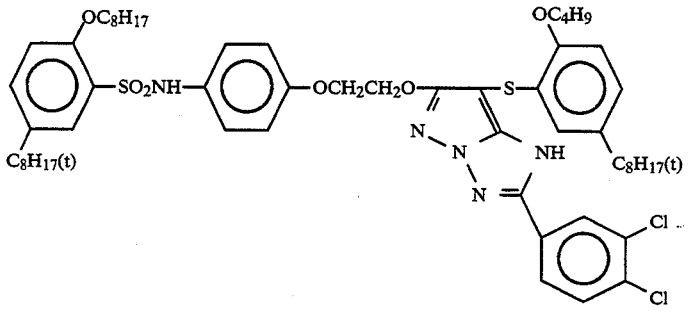
M-7
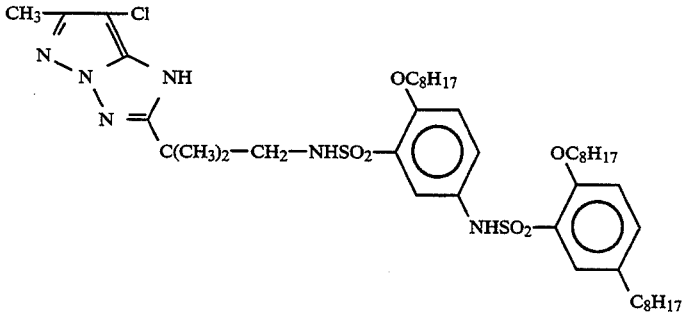
M-8
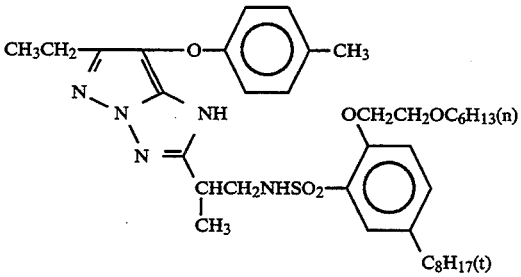
M-9
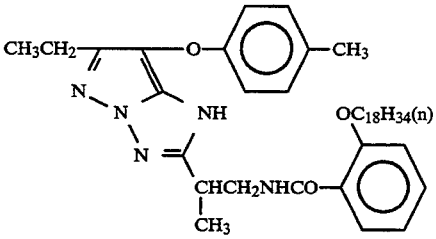

-continued
M-10
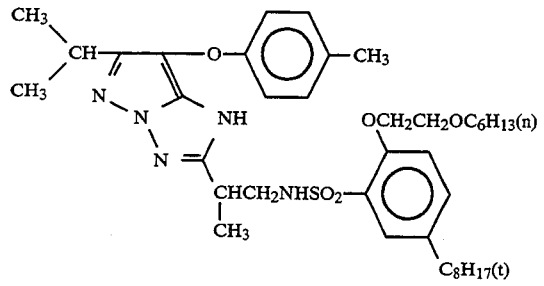
M-11
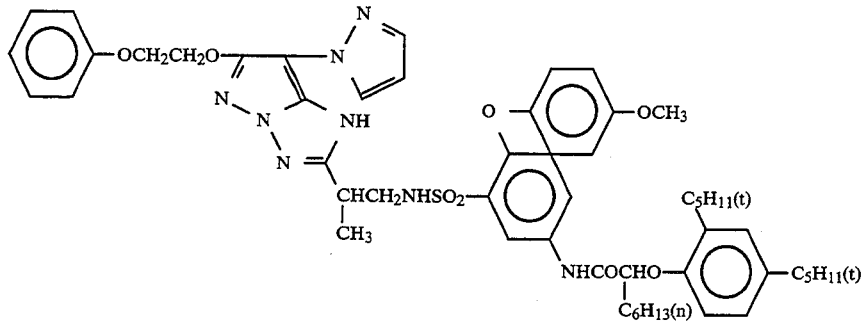
M-12
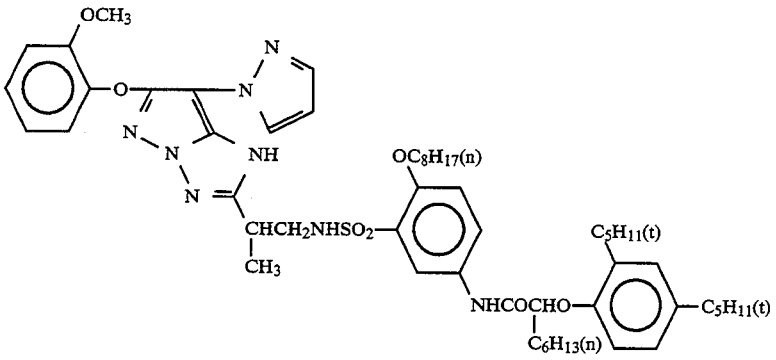
M-13
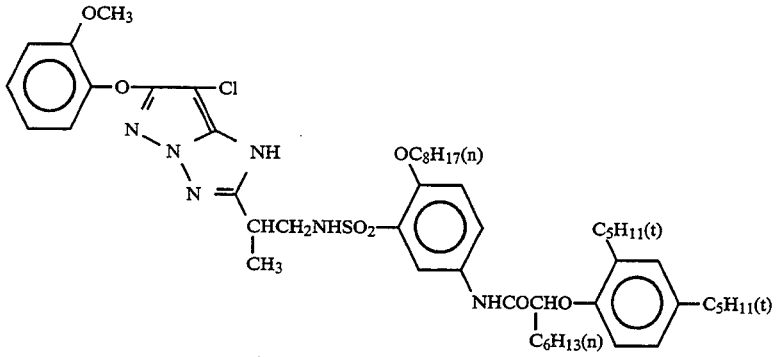
M-14
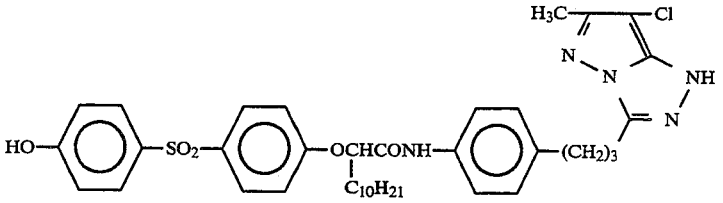

-continued

M-15

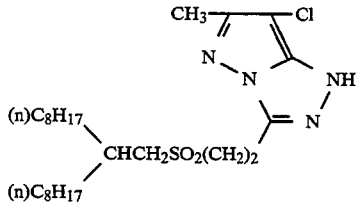

M-16

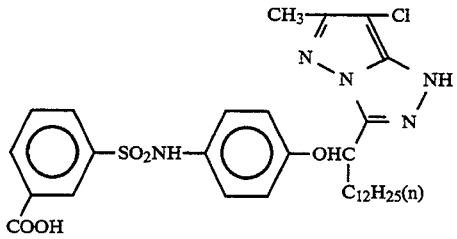

M-17

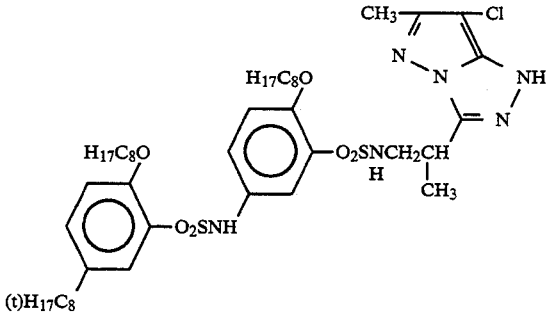

M-18

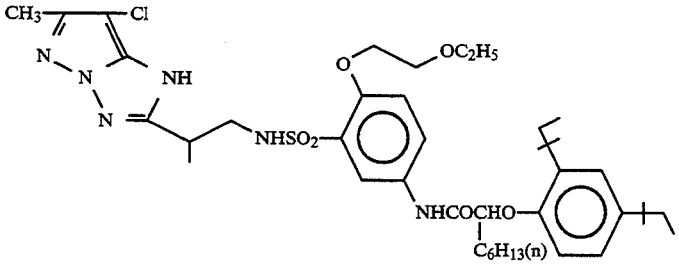

M-19

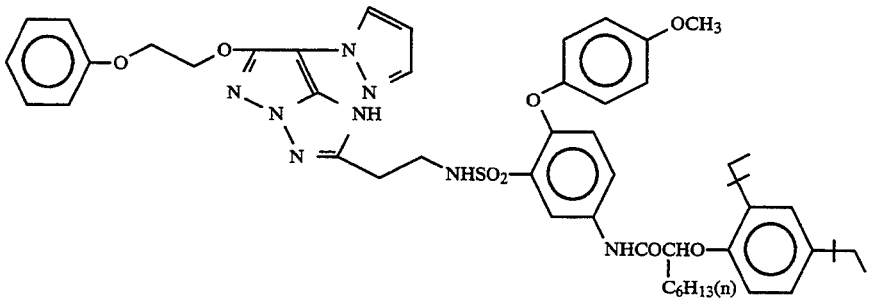

Examples of a cyan coupler are phenol and naphthol couplers, and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,343,011, and 4,327,173, EP Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Of these couplers, an ureido type cyan coupler represented by formula (III) and a 5-amidenaphthol type cyan coupler represented by formula (IV) are most preferable.

Formula (III)

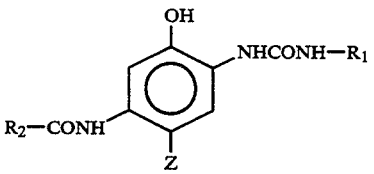

wherein $R_1$ represents a substituted or nonsubstituted aryl group, $R_2$ represents a substituted or nonsubstituted alkyl group, an aryl group, a cycloalkyl group, or a heterocyclic moiety, and Z represents a hydrogen atom or a coupling split-off group.
Practical examples of a cyan coupler represented by formula (III) will be described below, but the present invention is not limited to these examples.
C-1
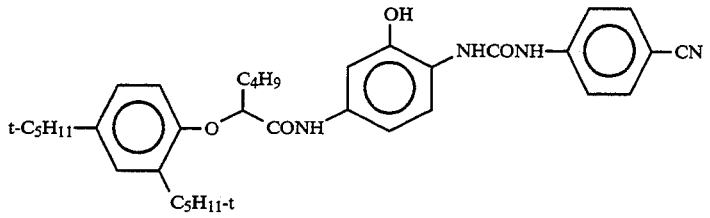
C-2
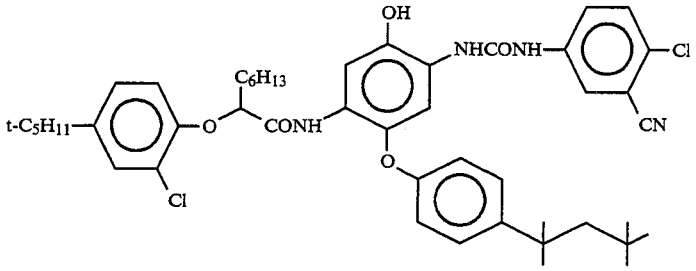
C-3
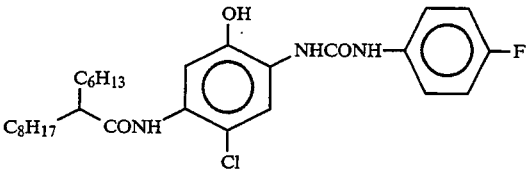
C-4
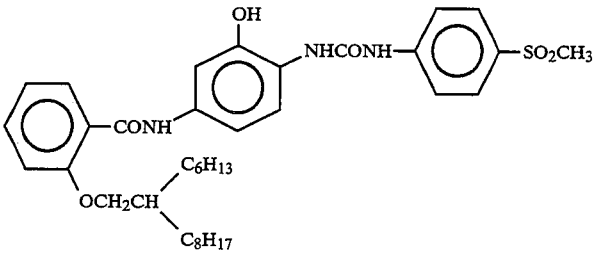
C-5
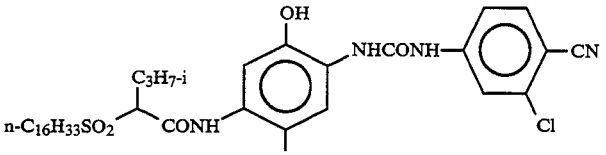
C-6
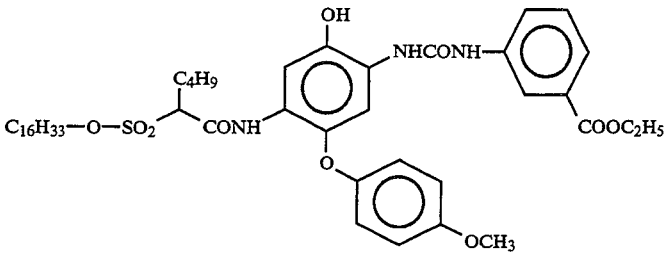
C-7
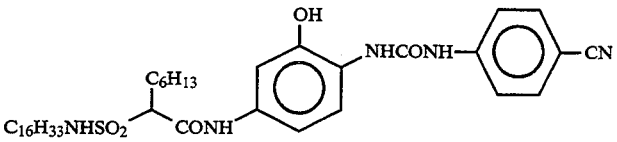

-continued

C-11

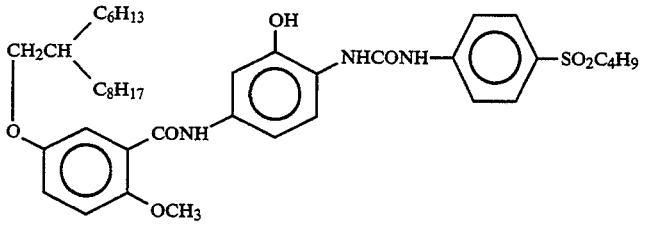

C-12

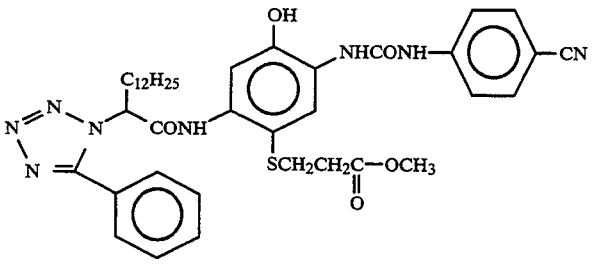

C-13

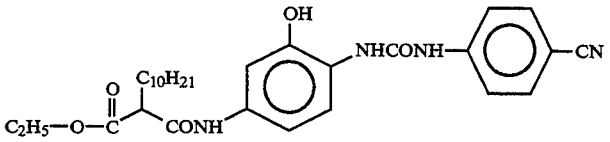

C-14

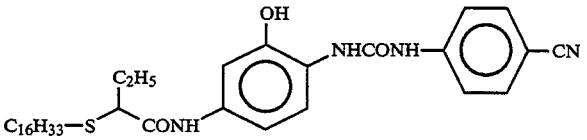

C-15

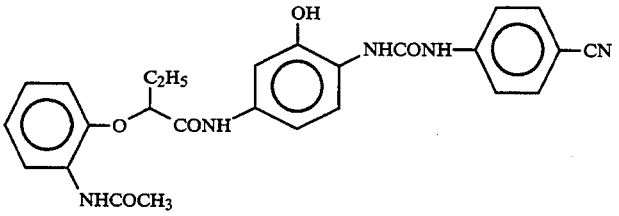

C-16

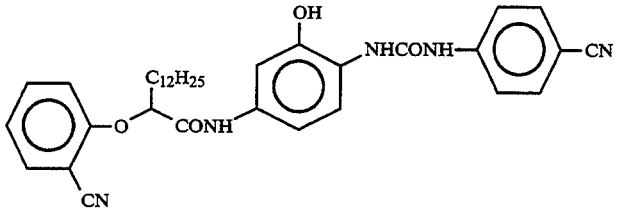

Formula (IV)

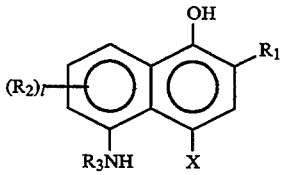

wherein $R_1$ represents $—CONR_4R_5$ or $—SO_2NR_4R_5$, $R_2$ represents a group which can be substituted on a naphthalene ring, l represents an integer of 0 to 3, $R_3$ represents an alkyl group, an aralkyl group, an acyl group, an alkoxycarbonyl group, an alkylaminocarbonyl group, or an alkylsulfonyl group, each of which can be substituted with, e.g., a halogen atom or an alkoxy group, and X represents a hydrogen atom or a group which can split off upon a coupling reaction with an oxidized form of an aromatic primary amine developing agent. $R_4$ and $R_5$ may be the same or different and each independently represents a hydrogen atom, an alkyl group, an aryl group, or a heterocyclic group. If l represents a plural number, $R_2$'s may be the same or different or may combine together to form a ring. $R_2$ and $R_3$ or $R_3$ and X may combine together to form a ring. $R_1$, $R_2$, $R_3$, or X may form dimers or higher polymers which combine together via a divalent group or a higher group.

Practical examples of a coupler represented by formula (IV) will be described below, but the present invention is not limited to these examples.

C-17

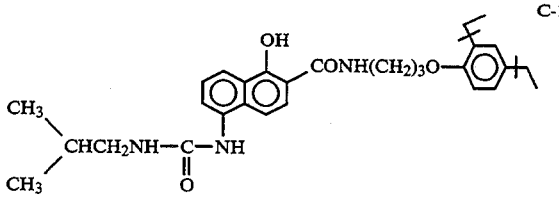

C-18

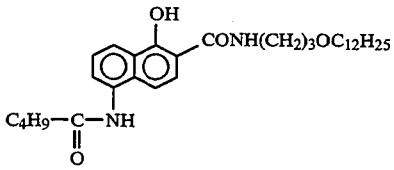

C-19

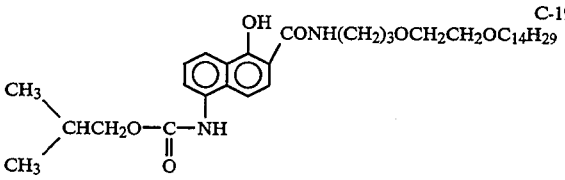

C-20

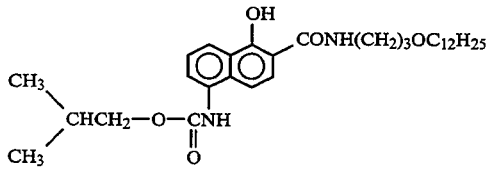

C-21

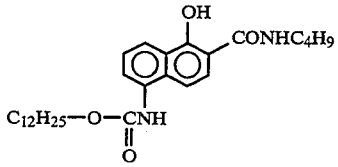

C-22

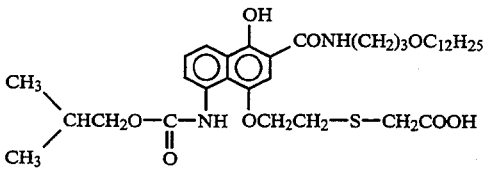

C-23

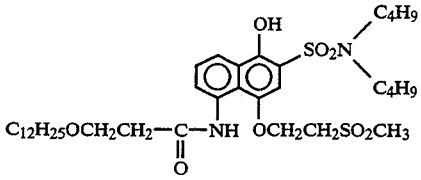

C-24

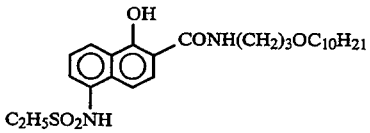

Typical examples of a polymerized dye-forming coupler are described in U.S. Pat. Nos. 3,451,820, 4,080,221, 4,367,282, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are those described in Research Disclosure No. 17643, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Couplers releasing a photographically useful residue upon coupling are preferably used in the present invention. DIR couplers, i.e., couplers releasing a development inhibitor are described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler for imagewise releasing a nucleating agent or a development accelerator, at the developing stage, are described in British Patents 2,097,140 and 2,131,188, JP-A-59-157638, and JP-A-59-170840. In addition, compounds for releasing a fogging agent, a development accelerator, or a silver halide solvent upon redox reaction with 10 an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; bleaching accelerator releasing couplers described in, e.g., RD. Nos. 11,449 and 24,241 and JP-A-61-201247; a legand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

Various types of an antiseptic agent or a mildewproofing agent are preferably added to the color light-sensitive material of the present invention. Examples of the antiseptic agent and the mildewproofing agent are 1,2-benzisothiazoline-3-one, n-butyl-p-hydroxybenzoate, phenol, 4-chloro-3.5-dimethylphenol, 2-phenoxyethanol, and 2-(4-thiazolyl)benzimidazole 10 described in JP-A-63-257747, JP-A-62-272248, and JP-A-1-80941.

The present invention can be applied to various color light-sensitive materials. Examples of the material are a color negative film for a general purpose or a movie, a color reversal film for a slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material using the photographic emulsion of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 sec. or less, and more preferably, 20 sec. or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation: (maximum swell film thickness—film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 615, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Of these compounds, 3-methyl-4-amino-N-ethyl-N-β-hydroxyethylaniline sulfate is most preferred. These compounds can be used in a combination of two or more thereof in accordance with the application.

In general, the color developer contains a pH buffering agent such as a carbonate, a borate, or a phosphate of an alkali metal, and a development restrainer or an antifoggant such as a bromide, an iodide, a benzimidazole, a benzothiazole, or a mercapto compound. If necessary, the color developer may also contain a preservative such as hydroxylamine, diethylhydroxylamine, sulfite, hydrazine, e.g., N,N-carboxymethyl hydrazine phenylsemlcarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye forming coupler; a competing coupler; an auxiliary developing agent such as 1-phenyl-3-pyrazolidone; a viscosity imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof.

The pH of the color and black-and-white developers is generally 9 to 12. Although a replenishment amount of the developer depends on a color photographic light-sensitive material to be processed, it is generally 3 liters or less per $m^2$ of the light-sensitive material. The replenishment amount can be decreased to be 500 ml or less by decreasing a bromide ion concentration in a replenishing solution. In order to decrease the replenishment amount, a contact area of a processing tank with air is preferably decreased to prevent evaporation and oxidation of the solution upon contact with air. The replenishment amount can be decreased by using a means capable of suppressing an accumulation amount of bromide ions in the developer.

A contact area of a photographic processing solution with air in a processing tank can be represented by an aperture defined below:

$$\text{Aperture} = \frac{\text{contact area (cm}^2\text{) of processing solution with air}}{\text{volume (cm}^3\text{) of processing solution}}$$

The above aperture is preferably 0.1 or less, and more preferably, 0.001 to 0.05. In order to reduce the aperture, a shielding member such as a floating cover may be provided on the liquid surface of the photographic processing solution in the processing tank. In addition, a method of using a movable cover described in JP-A-1-82033 or a slit developing method descried in JP-A-63-216050 may be used. The aperture is preferably reduced not only in color and black-and-white development steps but also in all subsequent steps, e.g., bleaching, bleach-fixing, fixing, washing, and stabilizing steps. In addition, a replenishing amount can be reduced by using a means of suppressing storage of bromide ions in the developing solution.

A color development time is normally two to five minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal such as iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivative described in JP-B-45-8506, JP-A-52-20832, JP-A-53-32735, and U.S. Pat. No. 3,706,561; a iodide salt described in West German Patents 1,127,715 and JP-A-58-16235; polyoxyethylene compounds descried in West German Patents 977,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid or propionic acid.

Examples of the fixing agent are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimadazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of strengthening the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsions surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyor means described in JP-A-60-191257, JP-A-191258, or JP-A-60-191259. As described in JP-A-60-191257, this conveyor means can significantly reduce carry-over of a processing solution from a pre-bath to a post-bath, thereby effectively preventing degradation in performance of the processing solution. This effect significantly shortens especially a processing time in each processing step and reduces a processing solution replenishing amount.

The photographic light-sensitive material of the present invention is normally subjected to washing and/or stabilizing steps after desilvering. An amount of water used in the washing step can be arbitrarily determined over a broad range in accordance with the properties (e.g., a property determined by use of a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955).

According to the above-described multi-stage counter-current scheme, the amount of water used for washing can be greatly decreased. Since washing water stays in the tanks for a long period of time, however, bacteria multiply and floating substances may be undesirably attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothiazolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), KogyogiJutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

Stabilizing is sometimes performed subsequently to washing. An example is a stabilizing bath containing a dye stabilizing agent and a surface-active agent to be used as a final bath of the photographic color light-sensitive material. Examples of the dye stabilizing agent are an aldehyde such as formalin and glutaraldehyde, an N-methylol compound, hexamethylenetetramine, and an aldehyde sulfurous acid adduct. various chelating agents or antifungal agents can be added in the stabilizing bath.

An overflow solution produced upon washing and/or replenishment of the stabilizing Solution can be resued in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, e.g., U.S. Pat. No. 4,500,626, JP-A-60-133449, JP-A-59-218443, JP-A-61-238056, and EP 210,660A2.

The present invention will be described in more detail below by way of its examples, but the present invention is not limited to these examples.

EXAMPLE

A plurality of layers having the following compositions were coated on an undercoated cellulose triacetate film support to form sample 101 as a multi-layered color light-sensitive material. Emulsions A to I, sensitizing dyes I to VII, and various compounds used in the following sample will be described later. YC-1 to YC-4 were also used as comparative couplers.

(Compositions of light-sensitive layers)

Numerals corresponding to each component indicates a coating amount represented in units of g/m$^2$. The coating amount of a silver halide is represented by the coating amount of silver. The coating amount of a sensitizing dye is represented in units of mols per mol of a silver halide in the same layer.

| (Sample 101) | | |
|---|---|---|
| Layer 1: Antihalation layer | | |
| Black colloidal silver | silver | 0.18 |
| Gelatin | | 1.40 |
| Layer 2: Interlayer | | |
| 2,5-di-t-pentadecylhydroquinone | | 0.18 |
| EX-1 | | 0.18 |
| EX-3 | | 0.020 |
| EX-12 | | $2.0 \times 10^{-3}$ |
| U-1 | | 0.060 |
| U-2 | | 0.080 |
| U-3 | | 0.10 |
| HBS-1 | | 0.10 |
| HBS-2 | | 0.020 |
| Gelatin | | 1.04 |
| Layer 3: 1st red-sensitive emulsion layer | | |
| Emulsion A | silver | 0.25 |
| Emulsion B | silver | 0.25 |

-continued (Sample 101)

| | | |
|---|---|---|
| Sensitizing dye I | | $6.9 \times 10^{-5}$ |
| Sensitizing dye II | | $1.8 \times 10^{-5}$ |
| Sensitizing dye III | | $3.1 \times 10^{-4}$ |
| EX-2 | | 0.17 |
| Compound (14) | | 0.020 |
| EX-14 | | 0.17 |
| U-1 | | 0.070 |
| U-2 | | 0.050 |
| U-3 | | 0.070 |
| HBS-1 | | 0.060 |
| Gelatin | | 0.87 |
| Layer 4: 2nd red-sensitive emulsion layer | | |
| Emulsion G | silver | 1.00 |
| Sensitizing dye I | | $5.1 \times 10^{-5}$ |
| Sensitizing dye II | | $1.4 \times 10^{-5}$ |
| Sensitizing dye III | | $2.3 \times 10^{-4}$ |
| EX-2 | | 0.20 |
| EX-3 | | 0.050 |
| Compound (14) | | 0.015 |
| EX-14 | | 0.20 |
| EX-15 | | 0.050 |
| U-1 | | 0.070 |
| U-2 | | 0.050 |
| U-3 | | 0.070 |
| Gelatin | | 1.30 |
| Layer 5: 3rd red-sensitive emulsion layer | | |
| Emulsion D | silver | 1.60 |
| Sensitizing dye I | | $5.4 \times 10^{-5}$ |
| Sensitizing dye II | | $1.4 \times 10^{-5}$ |
| Sensitizing dye III | | $2.4 \times 10^{-4}$ |
| EX-2 | | 0.097 |
| EX-3 | | 0.010 |
| EX-4 | | 0.080 |
| HBS-1 | | 0.22 |
| HBS-2 | | 0.10 |
| Gelatin | | 1.63 |
| Layer 6: Interlayer | | |
| EX-5 | | 0.040 |
| HBS-1 | | 0.020 |
| Gelatin | | 0.80 |
| Layer 7: lst green-sensitive emulsion layer | | |
| Emulsion A | silver | 0.15 |
| Emulsion B | silver | 0.15 |
| Sensitizing dye IV | | $3.0 \times 10^{-5}$ |
| Sensitizing dye V | | $1.0 \times 10^{-4}$ |
| Sensitizing dye VI | | $3.8 \times 10^{-4}$ |
| EX-1 | | 0.021 |
| EX-6 | | 0.26 |
| EX-7 | | 0.030 |
| Compound (27) | | 0.025 |
| HBS-1 | | 0.10 |
| HBS-3 | | 0.010 |
| Gelatin | | 0.63 |
| Layer 8: 2nd green-sensitive emulsion layer | | |
| Emulsion C | silver | 0.45 |
| Sensitizing dye IV | | $2.1 \times 10^{-5}$ |
| Sensitizing dye V | | $7.0 \times 10^{-5}$ |
| Sensitizing dye VI | | $2.6 \times 10^{-4}$ |
| EX-6 | | 0.094 |
| EX-7 | | 0.026 |
| Compound (27) | | 0.018 |
| HBS-1 | | 0.16 |
| HBS-3 | | $8.0 \times 10^{-3}$ |
| Gelatin | | 0.50 |

-continued (Sample 101)

| | | |
|---|---|---|
| Layer 9: 3rd green-sensitive emulsion layer | | |
| Emulsion E | silver | 1.20 |
| Sensitizing dye IV | | $3.5 \times 10^{-5}$ |
| Sensitizing dye V | | $8.0 \times 10^{-5}$ |
| Sensitizing dye VI | | $3.0 \times 10^{-4}$ |
| EX-1 | | 0.013 |
| EX-11 | | 0.065 |
| EX-13 | | 0.019 |
| HBS-1 | | 0.25 |
| HBS-2 | | 0.10 |
| Gelatin | | 0.54 |
| Layer 10: Yellow filter layer | | |
| Yellow colloidal silver | silver | 0.050 |
| EX-5 | | 0.080 |
| HBS-1 | | 0.030 |
| Gelatin | | 0.95 |
| Layer 11: lst blue-sensitive emulsion layer | | |
| Emulsion A | silver | 0.080 |
| Emulsion B | silver | 0.070 |
| Emulsion F | silver | 0.070 |
| Sensitizing dye VII | | $3.5 \times 10^{-4}$ |
| Compound (27) | | 0.042 |
| YC-1 | | 0.72 |
| HBS-1 | | 0.28 |
| Gelatin | | 1.10 |
| Layer 12: 2nd blue-sensitive emulsion layer | | |
| Emulsion G | silver | 0.45 |
| Sensitizing dye VII | | $2.1 \times 10^{-4}$ |
| YC-1 | | 0.15 |
| Compound (14) | | $7.0 \times 10^{-3}$ |
| HBS-1 | | 0.050 |
| Gelatin | | 0.78 |
| Layer 13: 3rd blue-sensitive emulsion layer | | |
| Emulsion H | silver | 0.77 |
| Sensitizing dye VII | | $2.2 \times 10^{-4}$ |
| YC-1 | | 0.20 |
| HBS-1 | | 0.070 |
| Gelatin | | 0.69 |
| Layer 14: lst protective layer | | |
| Emulsion I | silver | 0.20 |
| U-4 | | 0.11 |
| U-5 | | 0.17 |
| HBS-1 | | $5.0 \times 10^{-2}$ |
| Gelatin | | 1.00 |
| Layer 15: 2nd protective layer | | |
| H-1 | | 0.40 |
| B-1 (diameter = 1.7 μm) | | $5.0 \times 10^{-2}$ |
| B-2 (diameter = 1.7 μm) | | 0.10 |
| B-3 | | 0.10 |
| S-1 | | 0.20 |
| Gelatin | | 1.20 |

processibility, a resistance to pressure, antiseptic and mildewproofing properties, antistatic properties, and coating properties, all of the above layers were also added with W-1, w-2, w-3, B-4, B-5, F-1, F-2, F-3, F-4, F-5, F-6, F-7, F-8, F-9, F-10, F-! 1, F-12, F-13, iron salt, lead salt, gold salt, platinum salt, iridium salt, and rhodium salt.

As the emulsions A to I, those listed in Table 1 below were used.

TABLE 1

| Emulsion No. | Average AgI content (%) | Average grain size (mm) | Variation coefficient (%) according to grain size | Diameter/ thickness ratio | Silver amount ratio (AgI content %) |
|---|---|---|---|---|---|
| Emulsion A | 4.0 | 0.45 | 27 | 1 | Core/sheel = ⅓(13/1), Double structure grain |
| Emulsion B | 8.9 | 0.70 | 14 | 1 | Core/sheel = 3/7(25/2), Double structure grain |
| Emulsion C | 10 | 0.75 | 30 | 2 | Core/sheel = ½(24/3), Double structure grain |
| Emulsion D | 16 | 1.05 | 35 | 2 | Core/sheel = 4/6(40/0), Double structure grain |

TABLE 1-continued

| Emulsion No. | Average AgI content (%) | Average grain size (mm) | Variation coefficient (%) according to grain size | Diameter/ thickness ratio | Silver amount ratio (AgI content %) |
|---|---|---|---|---|---|
| Emulsion E | 10 | 1.05 | 35 | 3 | Core/sheel = ½(24/3), Double structure grain |
| Emulsion F | 4.0 | 0.25 | 28 | 1 | Core/sheel = ⅓(13/1), Double structure grain |
| Emulsion G | 14.0 | 0.75 | 25 | 2 | Core/sheel = ⅔(42/0), Double structure grain |
| Emulsion H | 14.5 | 1.30 | 25 | 3 | Core/sheel = 37/63(34/3) Double structure grain |
| Emulsion I | 1 | 0.07 | 15 | 1 | Uniform grain |

The structures of, e.g., the EX-series, the U-series, the HBS-series, the YC-series, the H-series, the B-series, and the S-series used in the above light-sensitive material are as follows.

EX-1

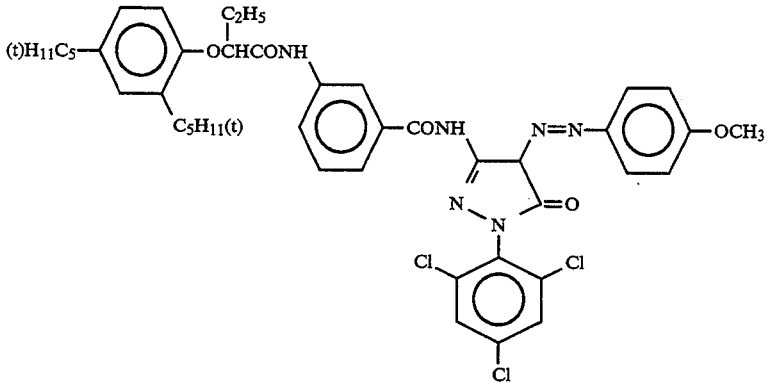

EX-2

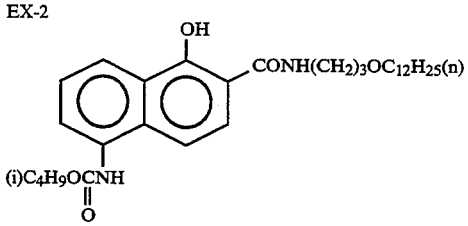

EX-3

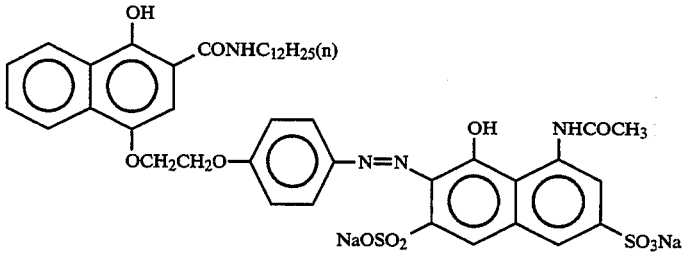

EX-4

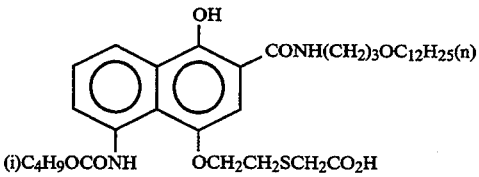

-continued
EX-5
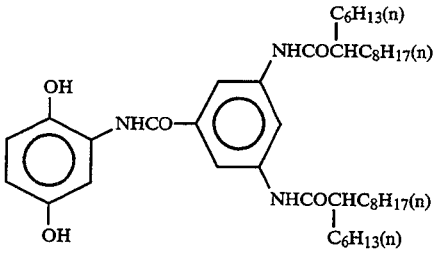
EX-6
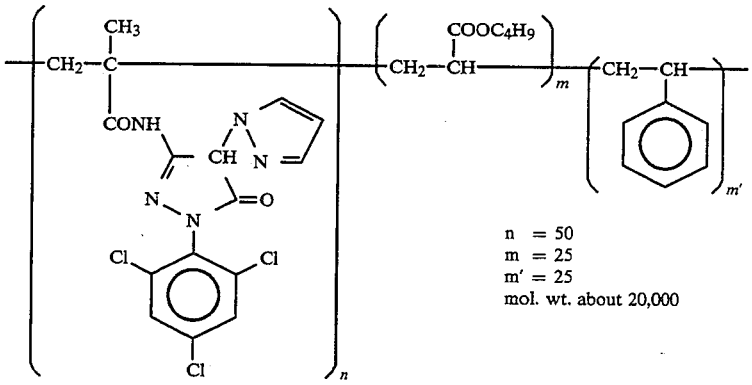
EX-7
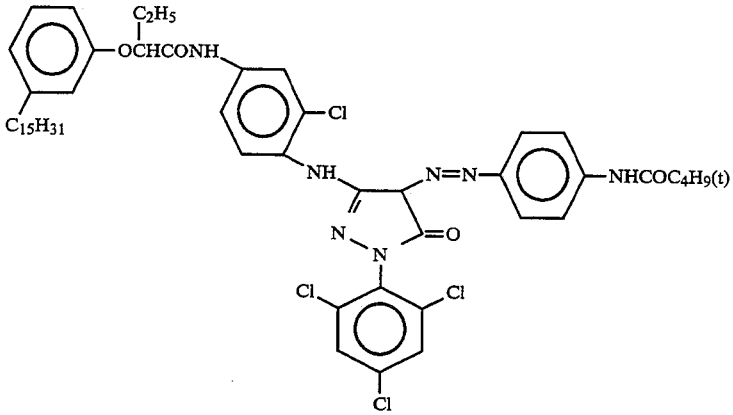
EX-11
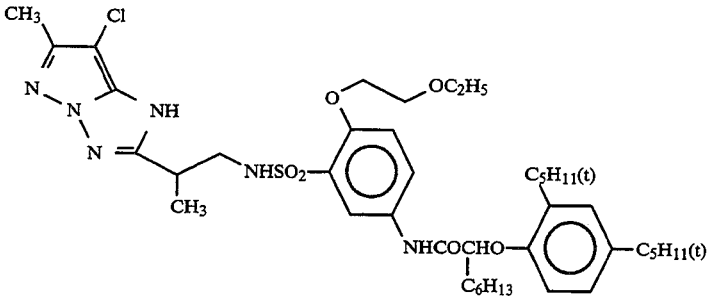
EX-12
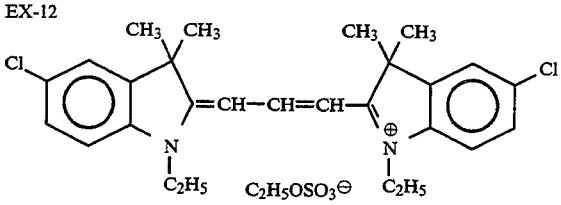

-continued
EX-13
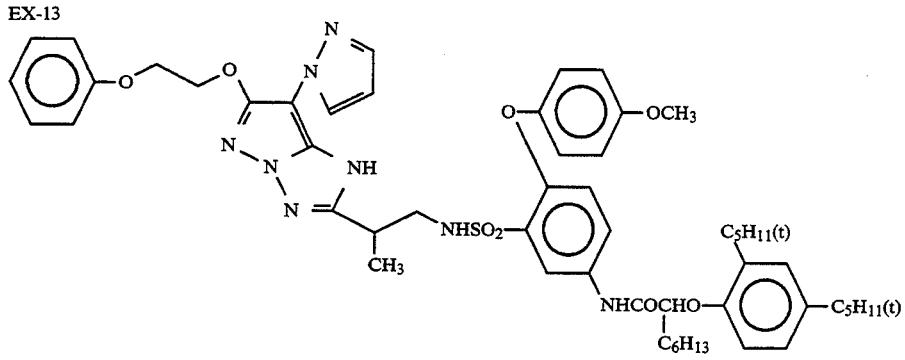
EX-14
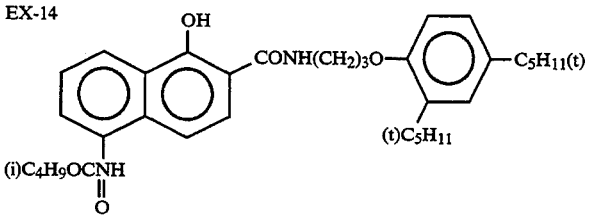
EX-15
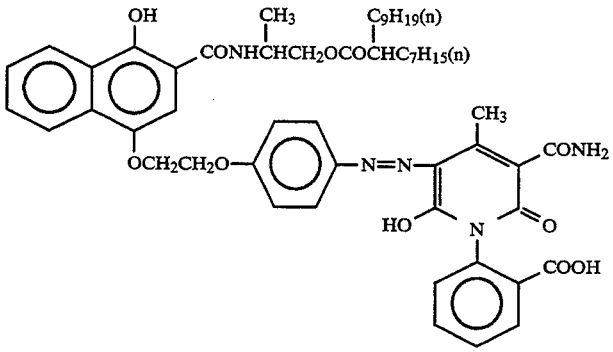
U-1
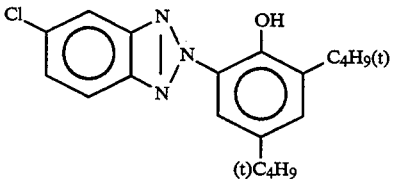
U-2
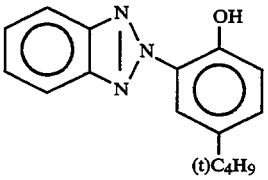
U-3
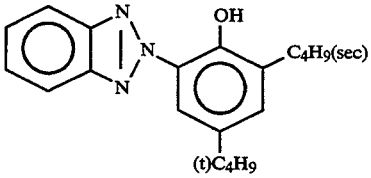

-continued
U-4
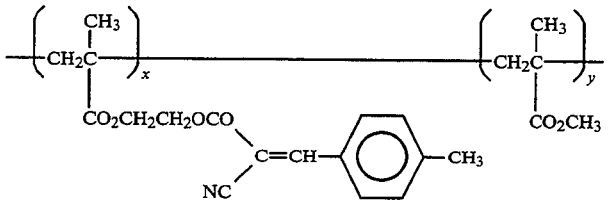
x:y = 70:30 (wt%)
U-5
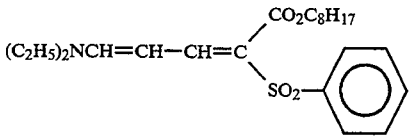
HBS-1 tricresyl phosphate
HBS-2 di-n-butylphthalate
HBS-3
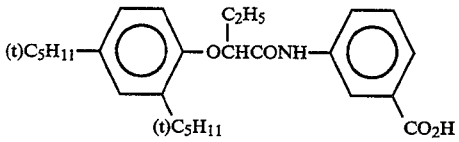
sensitizing dye I
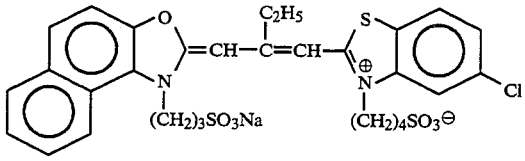
sensitizing dye II
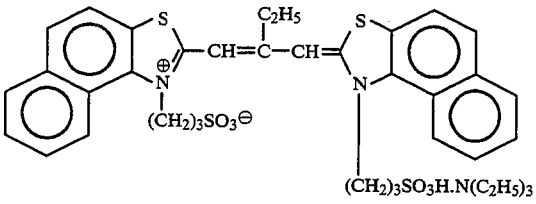
sensitizing dye III
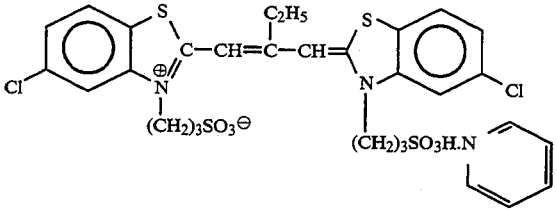
sensitizing dye IV
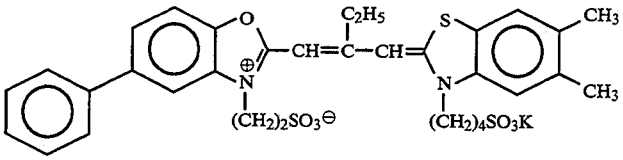

-continued
sensitizing dye V
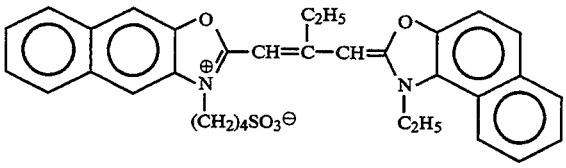
sensitizing dye VI
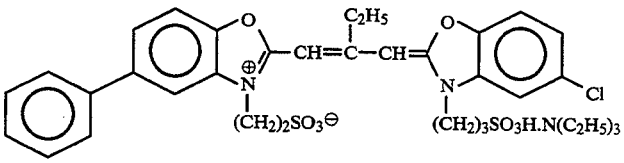
sensitizing dye VII
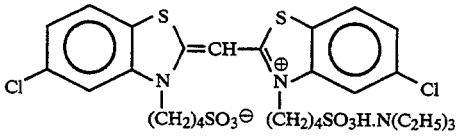
S-1
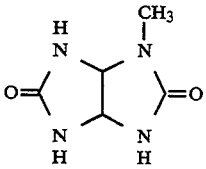
H-1
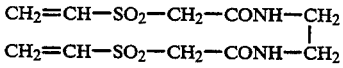
B-1
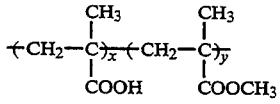
x/y = 10/90
B-2
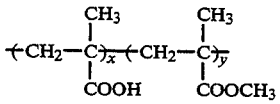
x/y = 40/60
B-3
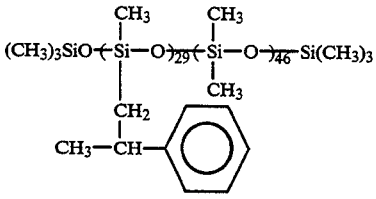
B-4
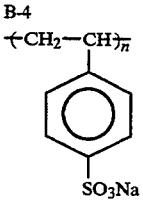

-continued
B-5
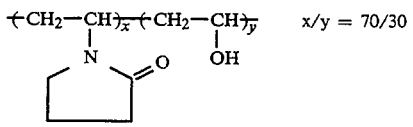
W-1
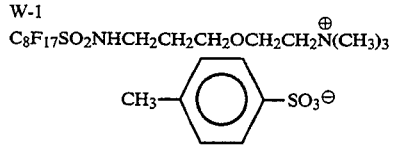
W-2
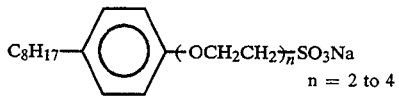
W-3
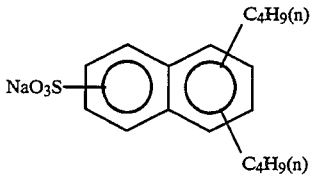
F-1
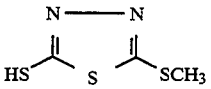
F-2
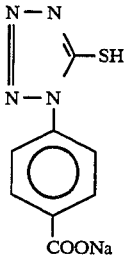
F-3
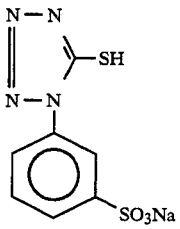
F-4
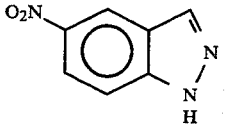
F-5
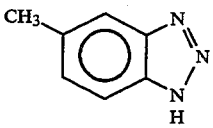

-continued
F-6
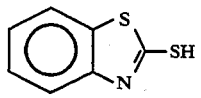
F-7
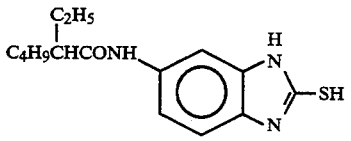
F-8
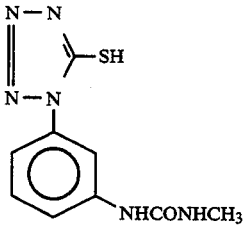
F-9
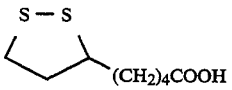
F-10
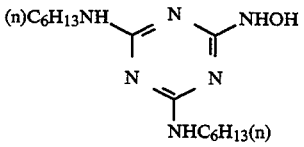
F-11
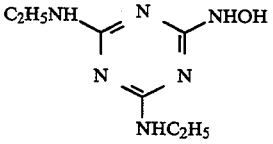
F-12
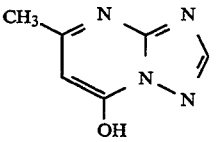
F-13
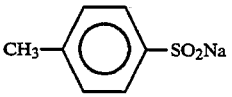
YC-1
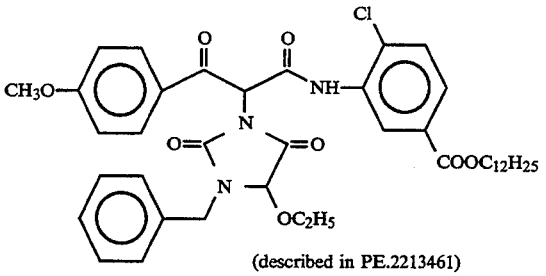
(described in PE.2213461)

-continued

YC-2

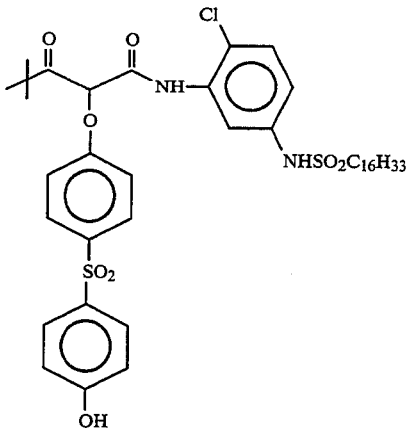

(U.S. Pat. No. 3933501)

YC-3

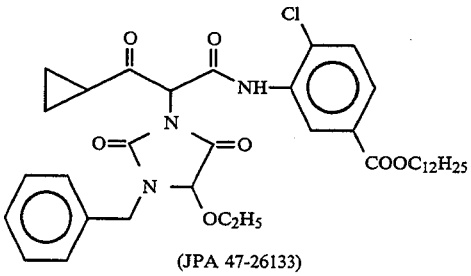

(JPA 47-26133)

YC-4

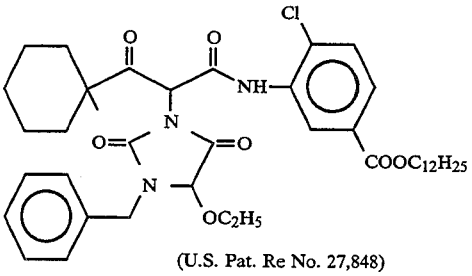

(U.S. Pat. Re No. 27,848)

(Samples 102–112)

The coupler YC-1 of the layers 11, 12, and 13 and the compounds of the layers 3 and 7 of the sample 101 were changed as shown in Table 2, thereby forming samples 102 to 110. In addition, samples 111 and 112 were formed by removing the compounds (14) and (27) from the layers 3, 4, 7, 8, 11, and 12 in the samples 105 and 107.

These samples were exposed imagewise with white light and subjected to the following color development. The amounts of the couplers used in the layers 11, 12, and 13 and that of the compound EX-15 used in the layer 4 were controlled such that a predetermined gamma (a slope of a line connecting a point of fog density+0.2 and a point of fog density+1.0) was obtained when each of the resultant samples was subjected to a density measurement through a blue filter.

These samples were then exposed with white light through an MTF measurement pattern. Subsequently, the following development was performed to measure the MTF value of a yellow dye image. The measurement of the MTF value was performed in accordance with the method described in Mies, "The Theory of Photographic Process 3rd. ed.," Macmillan Co., Ltd.

In addition, imagewise exposure was given to these samples with white light at a color temperature of 4,800×K through a blue filter. Subsequently, the following color development was performed to measure a yellow density with an exposure amount of 5 CMS, and this density was defined as a scale for the saturation of blue.

Each of the developed samples were stored under conditions of a temperature of 60° C. and a humidity of 70% for three months, and a yellow density was measured with the same exposure amount as described above, thereby obtaining a dye residual ratio. The results are summarized in Table 3.

TABLE 2

| Sample No. | Layer 3 | Layer 7 | Layer 11 | Layer 12 | Layer 13 |
|---|---|---|---|---|---|
| 101 (Comparative Example) | (14) | (27) | YC-1 | YC-1 | YC-1 |
| 102 (Comparative Example) | " | " | YC-2 | YC-2 | YC-2 |

TABLE 2-continued

| Sample No. | Layer 3 | Layer 7 | Layer 11 | Layer 12 | Layer 13 |
|---|---|---|---|---|---|
| 103 (Comparative Example) | " | " | YC-3 | YC-3 | YC-3 |
| 104 (Comparative Example) | " | " | YC-4 | YC-4 | YC-4 |
| 105 (Present Invention) | " | " | Y-7 | Y-7 | Y-7 |
| 106 (Present Invention) | " | " | Y-16 | Y-16 | Y-16 |
| 107 (Present Invention) | " | " | Y-15 | Y-15 | Y-15 |
| 108 (Present Invention) | (35) | " | " | " | " |
| 109 (Present Invention) | (14) | (35) | " | " | " |
| 110 (Present Invention) | " | (26) | " | " | " |
| 111 (Comparative Example) | — | — | Y-7 | Y-7 | Y-7 |
| 112 (Comparative Example) | — | — | Y-15 | Y-15 | Y-15 |
| 113 (Present Invention) | (16) | (16) | Y-7 | Y-7 | Y-7 |

TABLE 3

| Sample No. | MTF Value 10 cycle/min | Yellow density with exposure amount of 5 CMS | Color dye residual ratio |
|---|---|---|---|
| 101 (Comparative Example) | 0.39 | 2.24 | 55% |
| 102 (Comparative Example) | 0.40 | 2.10 | 50 |
| 103 (Comparative Example) | 0.40 | 2.10 | 20% |
| 104 (Comparative Example) | 0.36 | 1.99 | 90% |
| 105 (Present Invention) | 0.43 | 2.27 | 80% |
| 106 (Present Invention) | 0.45 | 2.30 | 85% |
| 107 (Present Invention) | 0.46 | 2.32 | 89% |
| 108 (Present Invention) | 0.47 | 2.32 | 88% |
| 109 (Present Invention) | 0.47 | 2.32 | 89% |
| 110 (Present Invention) | 0.46 | 2.31 | 92% |
| 111 (Comparative Example) | 0.42 | 1.97 | 83% |
| 112 (Comparative Example) | 0.42 | 1.98 | 92% |
| 113 (Present Invention) | 0.46 | 2.31 | 90% |

TABLE 3-continued

| Sample No. | MTF Value 10 cycle/min | Yellow density with exposure amount of 5 CMS | Color dye residual ratio |
|---|---|---|---|
| Invention) | | | |

The above color development was as follows.

| Process | Processing Method Time | Temperature |
|---|---|---|
| Color development | 3 min. 15 sec. | 38° C. |
| Bleaching | 6 min. 30 sec. | 38° C. |
| Washing | 2 min. 10 sec. | 24° C. |
| Fixing | 4 min. 20 sec. | 38° C. |
| Washing (1) | 1 min. 05 sec. | 24° C. |
| Washing (2) | 1 min. 00 sec. | 24° C. |
| Stabilization | 1 min. 05 sec. | 38° C. |
| Drying | 4 min. 20 sec. | 55° C. |

The compositions of the processing solutions used in the above color development were as follows.

| | | |
|---|---|---|
| Color developing solution: | | (g) |
| Diethylenetriamine pentaacetate | 1.0 | |
| 1-hydroxyethylidene-1,1-diphosphonic acid | 3.0 | |
| Sodium sulfite | 4.0 | |
| Potassium carbonate | 30.0 | |
| Potassium bromide | 1.4 | |
| Potassium iodide | 1.5 mg | |
| Hydroxylamine sulfate | 2.4 | |
| 4-[N-ethyl-N-β-hydroxyethylamino]-2-methylaniline sulfate | 4.5 | |
| Water to make | 1.0 l | |
| pH | 10.05 | |
| Bleaching solution: | | (g) |
| sodium ethylenediamine tetraacetato ferrate (III) trihydrate | 100.0 | |
| Disodium ethylenediamine tetraacetate | 10.0 | |
| Ammonium bromide | 140.0 | |
| Ammonium nitrate | 30.0 | |
| Ammonia water (27%) | 6.5 ml | |
| Water to make | 1.0 | |
| pH | 6.0 | |
| Fixing solution: | | (g) |
| Disodium ethylenediamine tetraacetate | 0.5 | |
| Sodium sulfite | 7.0 | |
| Sodium bisulfate | 5.0 | |
| Aqueous ammonium thiosulfate solution (70%) | 170.0 ml | |
| Water to make | 1.0 l | |
| pH | 6.7 | |
| Stabilizing solution: | | (g) |
| Formalin (37%) | 2.0 ml | |
| Polyoxyethylene-p-monononylphenylether (average polymerization degree = 10) | 0.3 | |
| Disodium ethylenediamine tetraacetate | 0.05 | |
| Water to make | 1.0 l | |
| pH | 5.0–8.0 | |

What is claimed is:

1. A silver halide photographic light-sensitive material comprising:

a support; and at least one light-sensitive silver halide emulsion layer formed on said support, wherein at least one of said light-sensitive silver halide emulsion layers contains at least one type of an acylacetamide type yellow dye forming coupler having an acyl group represented by formula (I) below, and at least one type of a compound represented by formula (W) below:

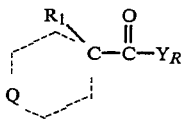

Formula (I)

wherein $R_1$ represents a monovalent group and Q represents a nonmetallic atomic group required to form, together with C, a 3- to 5-membered hydrocarbon ring, $R_1$ is not a hydrogen atom and does not combine with Q to form a ring, and $Y_R$ represents a residue remaining after removing the acyl group:

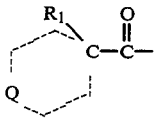

from the acylacetamido yellow dye forming coupler represented by formula (I):

$$A-\{(L_1)_l-(B)_m\}_p-(L_2)_n-DI$$ Formula (W)

wherein A represents a group whose bond with a moiety having the formula $\{(L_1)_l-(B)_m\}_p-(L_2)_n-DI$ cleaves when reacting with an oxidized form of an aromatic primary amine developing agent, $L_1$ represents a group whose bond (a bond with $(B)_m$) on the right side of $L_1$ in formula (W) cleaves when a bond on the left side of $L_1$ cleaves, B represents a group whose bond with the right side of B in formula (W) cleaves when reacting with the oxidized form of a developing agent, $L_2$ represents a group whose bond on the right side of $L_2$ in formula (W) cleaves when a bond on the left side of $L_2$ cleaves, DI represents a development inhibitor, each of l, m and n independently represents 0 or 1, and p represents an integer of 0 to 3, if p represents a plural number, p $(L_1)_l-(B)_m$'s may be the same or different.

2. A silver halide photographic light-sensitive material according to claim 1, wherein said group A in the formula (W) is a coupler moiety.

3. A silver halide photographic light-sensitive material according to claim 1, wherein said group A in the formula (W) is an oxidation-reduction group.

4. A silver halide photographic light-sensitive material according to claim 1, wherein said linking groups $L_1$ and $L_2$ in the formula (W) are timing groups which cause cleaving reaction by using an intramolecular nucleophilic reaction.

5. A silver halide photographic light-sensitive material according to claim 1, wherein said linking groups $L_1$ and $L_2$ in the formula (W) are timing groups which cause clearing reaction by using an electron transfer reaction.

6. A silver halide photographic light-sensitive material according to claim 1, wherein said $R_1$ in the formula (I) is a substituted or non-substituted monovalent group having a total number of carbon atoms of 1 to 30.

7. A silver halide photographic light-sensitive material according to claim 6, wherein said $R_1$ is an alkyl group.

8. A silver halide photographic light-sensitive material according to claim 7, wherein said $R_1$ is a methyl group.

9. A silver halide photographic light-sensitive material according to claim 7, wherein said $R_1$ is an ethyl group.

10. A silver halide photographic light-sensitive material according to claim 1, wherein said Q in the formula (I) forms 3-membered ring together with C.

11. A silver halide photographic light-sensitive material according to claim 1 wherein said acylacetamide type yellow dye forming coupler is the one represented by the following formula (Y).

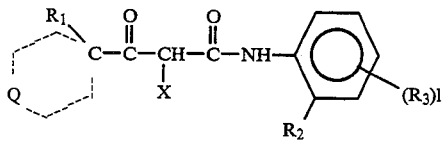

Formula (Y)

wherein X is a group represented ;by the following formula (Y-1):

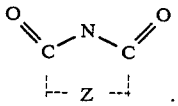

Formula (Y-1)

12. A silver halide photographic light-sensitive material according to claim 1, wherein said acylacetamide type yellow dye forming coupler is the one represented by the following formula (Y):

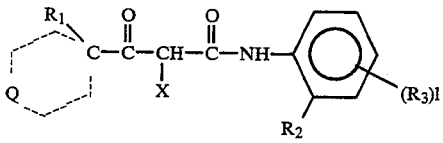

Formula (Y)

wherein X is a group represented by the following formula (Y-2):

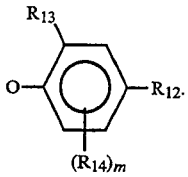

Formula (Y-2)

13. A silver halide photographic light-sensitive material according to claim 1, further comprising a high boiling organic solvent represented by the following formula (S-1) or (S-2):

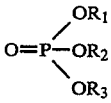

Formula (S-1)

-continued

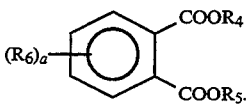

Formula (S-2)

14. A silver halide photographic light-sensitive material according to claim 13, wherein said $R_4$ and $R_5$ in the formula (S-2) are independently an alkyl group, cycloalkyl group or an aryl group, and $R_6$ in the formula (S-2) is a halogen atom, an alkyl group, an alkoxy group, an aryloxy group or an alkoxycarbonyl group.

15. A silver halide photographic light-sensitive material according to claim 1, wherein a first compound of formula (W) in which $f+m+n+p \geqq 3$ is used in combination with a second compound of formula (W) in which $f+m+n+p$ is 0 to 2.

16. A silver halide photographic light-sensitive material according to claim 1, wherein a compound represented by formula (W) is a nondiffusing compound.

17. A silver halide photographic light-sensitive material according to claim 16, wherein the nondiffusing compound is contained in A, $L_1$ or $L_2$.

18. A silver halide photographic light-sensitive material according to claim 1, wherein a compound represented by formula (W) is a compound in which $l=1$, $m=0$, $p=1$, and $n=1$; $l=1$, $m=1$, $p=1$, and $n=0$; $l=0$, $m=1$, $p=1$, and $n=1$; or $l=0$, $m=1$, $p=2$, and $n=0$.

19. A silver halide photographic light-sensitive material according to claim 1, wherein a compound represented by formula (W) is present in an amount of $2\times10^{-4}$ to $1\times10^{-1}$ mol per mol of silver halide.

* * * * *